US009526313B2

(12) United States Patent
Asako

(10) Patent No.: US 9,526,313 B2
(45) Date of Patent: Dec. 27, 2016

(54) DRAWING APPARATUS AND METHOD FOR DRAWING WITH DRAWING APPARATUS

(71) Applicant: CASIO COMPUTER CO., LTD., Shibuya-ku, Tokyo (JP)

(72) Inventor: Kenichiro Asako, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 137 days.

(21) Appl. No.: 14/537,695

(22) Filed: Nov. 10, 2014

(65) Prior Publication Data

US 2015/0128981 A1 May 14, 2015

(30) Foreign Application Priority Data

Nov. 11, 2013 (JP) ..... 2013-232804

(51) Int. Cl.
*H04N 1/46* (2006.01)
*A45D 29/00* (2006.01)

(52) U.S. Cl.
CPC ..... *A45D 29/00* (2013.01); *A45D 2029/005* (2013.01)

(58) Field of Classification Search
None
See application file for complete search history.

(56) References Cited

U.S. PATENT DOCUMENTS 3,669,069 A * 6/1972 Bourboulis ..... B05C 17/10 118/102
3,873,769 A * 3/1975 Cotter ..... G01D 15/00 178/18.01
3,903,526 A * 9/1975 Cotter ..... G06K 15/22 346/139 R
4,157,936 A * 6/1979 Piazza ..... G03F 7/422 216/13
4,243,700 A * 1/1981 Piazza ..... B41M 7/02 216/49
4,849,771 A * 7/1989 Lawrence ..... B43L 13/024 235/456
4,859,807 A * 8/1989 Swiggett ..... H05K 3/103 174/259
4,933,876 A * 6/1990 Markoff ..... G01D 15/16 346/139 R
5,165,013 A * 11/1992 Faris ..... G02B 27/0093 345/419

(Continued)

FOREIGN PATENT DOCUMENTS

JP 2003534083 A 11/2003

*Primary Examiner* — Ted Barnes
(74) *Attorney, Agent, or Firm* — Holtz, Holtz & Volek PC

(57) ABSTRACT

A drawing apparatus includes a drawing head, a movement mechanism, and a control unit. The drawing head holds at least one modification member having a first tip at its one end and operates in such a way as to allow the first tip of the modification member to touch ink which is undried or uncured and applied to a drawing target. The movement mechanism moves the drawing head. The control unit controls the drawing head and the movement mechanism. The control unit controls a modification operation in which the movement mechanism moves the modification member through the drawing head while the first tip is touching the ink on the drawing target so that a part of a pattern formed with the ink on the drawing target is modified.

15 Claims, 10 Drawing Sheets

(56) References Cited

U.S. PATENT DOCUMENTS 5,513,991 A * 5/1996 Reynolds ..... G09B 11/10 348/61
5,676,549 A * 10/1997 Arad ..... G09B 11/10 206/1.7
5,693,141 A * 12/1997 Tramont ..... B05C 17/0207 118/211
5,958,525 A * 9/1999 Green ..... A63H 33/22 428/100
6,013,132 A * 1/2000 Tramont ..... B05C 17/0207 118/211
6,286,517 B1 * 9/2001 Weber ..... A45D 29/00 132/200
2002/0050215 A1 * 5/2002 King ..... B44D 2/00 101/41
2004/0027443 A1 * 2/2004 Trent ..... B41J 3/36 347/109
2004/0080787 A1 * 4/2004 Kakikawa ..... B41M 7/0009 358/1.18
2004/0159977 A1 * 8/2004 Perfetto ..... B28B 11/001 264/293
2004/0196348 A1 * 10/2004 Roberts ..... B41J 3/38 347/101
2005/0196543 A1 * 9/2005 Morton ..... B05B 12/124 427/421.1
2006/0180039 A1 * 8/2006 Leite ..... B41K 1/06 101/368
2006/0204724 A1 * 9/2006 Argoitia ..... B05D 3/12 428/172
2007/0095220 A1 * 5/2007 Cox ..... A01G 1/00 101/127
2007/0103529 A1 * 5/2007 Pearl ..... B41J 3/28 347/101
2007/0171237 A1 * 7/2007 Pinter ..... G06T 11/60 345/629
2007/0200002 A1 * 8/2007 Raksha ..... B41M 3/148 235/491
2008/0018650 A1 * 1/2008 Sander ..... G06T 15/40 345/441
2009/0280150 A1 * 11/2009 Kamen ..... A45D 34/04 424/401
2010/0143593 A1 * 6/2010 Sano ..... B41J 2/2114 427/265
2010/0156581 A1 * 6/2010 Gueret ..... A45D 29/22 335/219
2011/0212254 A1 * 9/2011 Morton ..... B05B 12/124 427/8
2013/0070307 A1 * 3/2013 Barnoy ..... B41J 2/2114 358/3.29
2013/0077103 A1 * 3/2013 Asako ..... A45D 29/00 358/1.2
2013/0140806 A1 * 6/2013 Wilkinson ..... B41M 7/0045 283/109
2014/0204168 A1 * 7/2014 Umetsu ..... B41J 29/36 347/179
2014/0267364 A1 * 9/2014 Lapinski ..... G09G 5/026 345/593
2014/0343212 A1 * 11/2014 Diebold ..... C09C 1/3661 524/437
2015/0217307 A1 * 8/2015 Raksha ..... B05D 3/207 118/640

* cited by examiner

DRAWING APPARATUS AND METHOD FOR DRAWING WITH DRAWING APPARATUS

CROSS-REFERENCE TO RELATED APPLICATIONS

This application is based upon and claims the benefit of priority from the prior Japanese Patent Application No. 2013-232804, filed on Nov. 11, 2013, the entire contents of which are incorporated herein by reference.

BACKGROUND OF THE INVENTION

1. Field of the Invention

The present invention relates to a drawing apparatus and a method for drawing with a drawing apparatus.

2. Description of the Related Art

Nail art, i.e., creation of various patterns on nails with nail polish etc., has been very popular. Such nail art is often made by specialized staffs at nail salons.

In recent years, there have been nail printing apparatuses to print nail designs on nails. Such a nail printing apparatus is disclosed in, for example, Japanese Unexamined Patent Application Publication (Translation of PCT Application) No. 2003-534083. Such a nail printing apparatus allows users to easily enjoy nail art without the need to go to nail salons.

In many nail salons, specialized staffs not only apply nail polish on nails but also modify the applied nail polish on the nails with a fine brush etc. to create seemingly irregular and complicated patterns, such as peacock pattern and marble pattern.

There has been demand that complicated patterns, such as peacock pattern and marble pattern be easily created without using nail salons.

To create peacock pattern and marble pattern, a person has to modify the ink on a nail with a fine brush etc. by hand after drawing a basic design on the nail.

Such a work requires much time and effort, and it is difficult for a person who is not used to nail art, in particular, to create an intended pattern without fail. The creation of nail art on the nails of dominant-hand fingers with a non-dominant hand is especially difficult even for a person who is used to nail art. Hence, the finish of a created pattern on nails is sometimes different between right and left hands.

If a nail printing apparatus is used to create such a pattern having a unique and seemingly irregular texture, the resulting created pattern is only a planar and less attractive one.

BRIEF SUMMARY OF THE INVENTION

The present invention provides a drawing apparatus and a method for drawing with a drawing apparatus that can create seemingly irregular and complicated pattern, such as peacock pattern and marble pattern, without requiring time and effort of users.

According to a first aspect of the present invention, there is provided a drawing apparatus including: a drawing head which holds at least one modification member having a first tip at one end thereof and operates in such a way as to allow the first tip of the modification member to touch ink which is undried or uncured and is applied to a drawing target; a movement mechanism to move the drawing head; a control unit to control the drawing head and the movement mechanism, wherein the control unit controls a modification operation in which the movement mechanism moves the modification member through the drawing head while the first tip touches the ink on the drawing target so that a part of a pattern formed with the ink on the drawing target is modified.

According to a second aspect of the present invention, there is provided a drawing method for a drawing apparatus, the method including: allowing a drawing head to hold at least one modification member having a first tip at one end thereof; allowing, with the drawing head, the first tip of the modification member to touch ink which is undried or uncured and is applied to a drawing target; and performing a modification operation in which the modification member is moved through the drawing head while the first tip touches the ink so that a part of a pattern formed with the ink on the drawing target is modified.

BRIEF DESCRIPTION OF THE SEVERAL VIEWS OF THE DRAWING

The above and other objects, advantages and features of the present invention will become more fully understood from the detailed description given hereinbelow and the appended drawings which are given by way of illustration only, and thus are not intended as a definition of the limits of the present invention, and wherein:

FIG. 5A is a side view of the drawing tool carriage and drawing tool, FIG. 5B is a top view of the drawing tool carriage and drawing tool, seen from the direction of arrow b of FIG. 5A, and FIG. 5C is a front view of the drawing tool carriage and drawing tool, seen from the direction of arrow c of FIG. 5A;

DETAILED DESCRIPTION OF THE INVENTION

Figure 1:
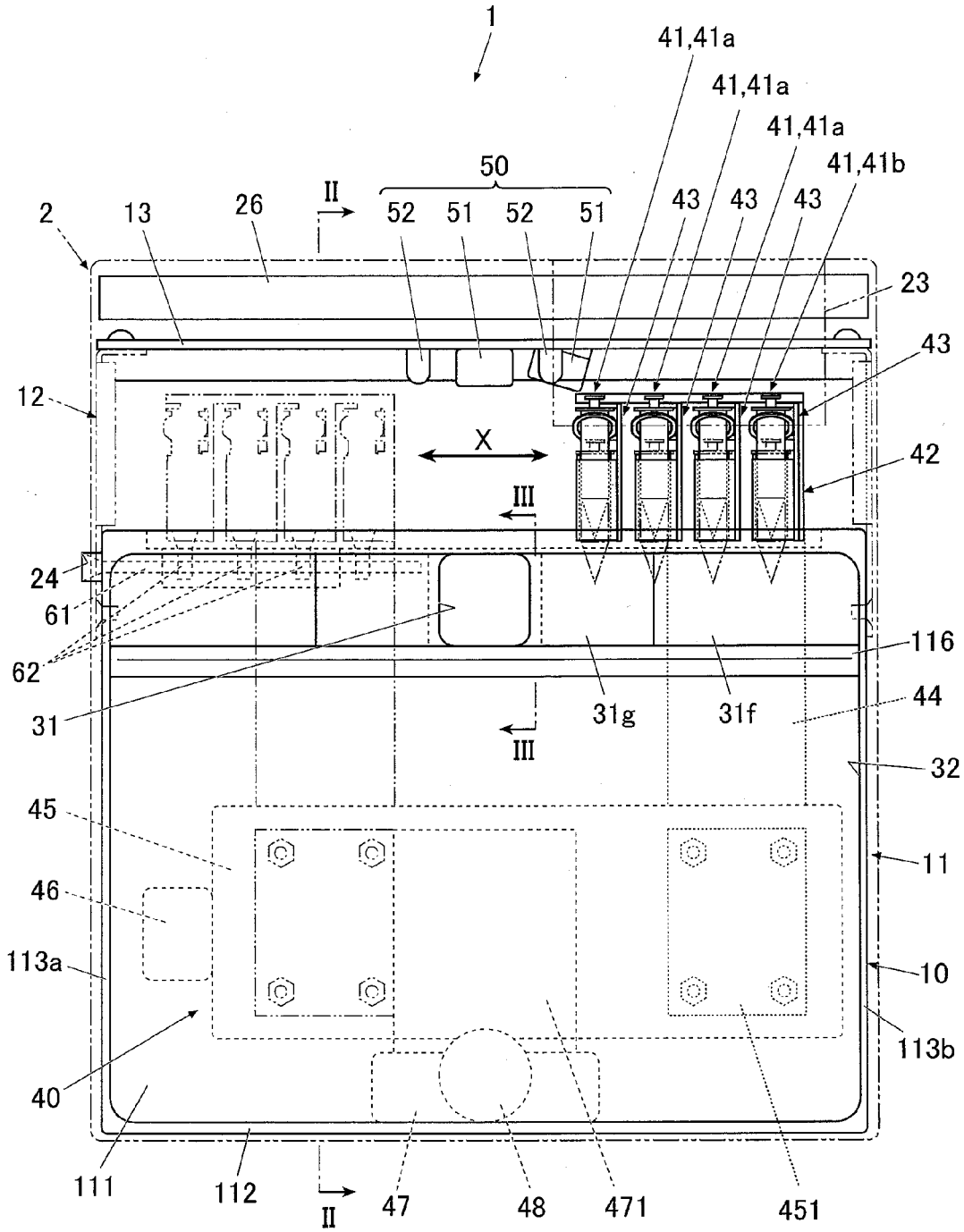
FIG. 1 is a front view of a drawing apparatus in this embodiment.

An embodiment of a drawing apparatus according to the present invention will now be described in detail with reference to the drawings.

The embodiment described below has various limitations which are technically preferable to carry out the present invention. The scope of the present invention, however, is not limited to the embodiment below and the example shown in the drawings.

The drawing apparatus of the embodiment perform drawing on nails of fingers (including thumbs) as a drawing target. The drawing target, however, is not limited to fingernails but may be toenails.

FIG. 1 is a front view of a drawing apparatus 1 of this embodiment.

Figure 2:
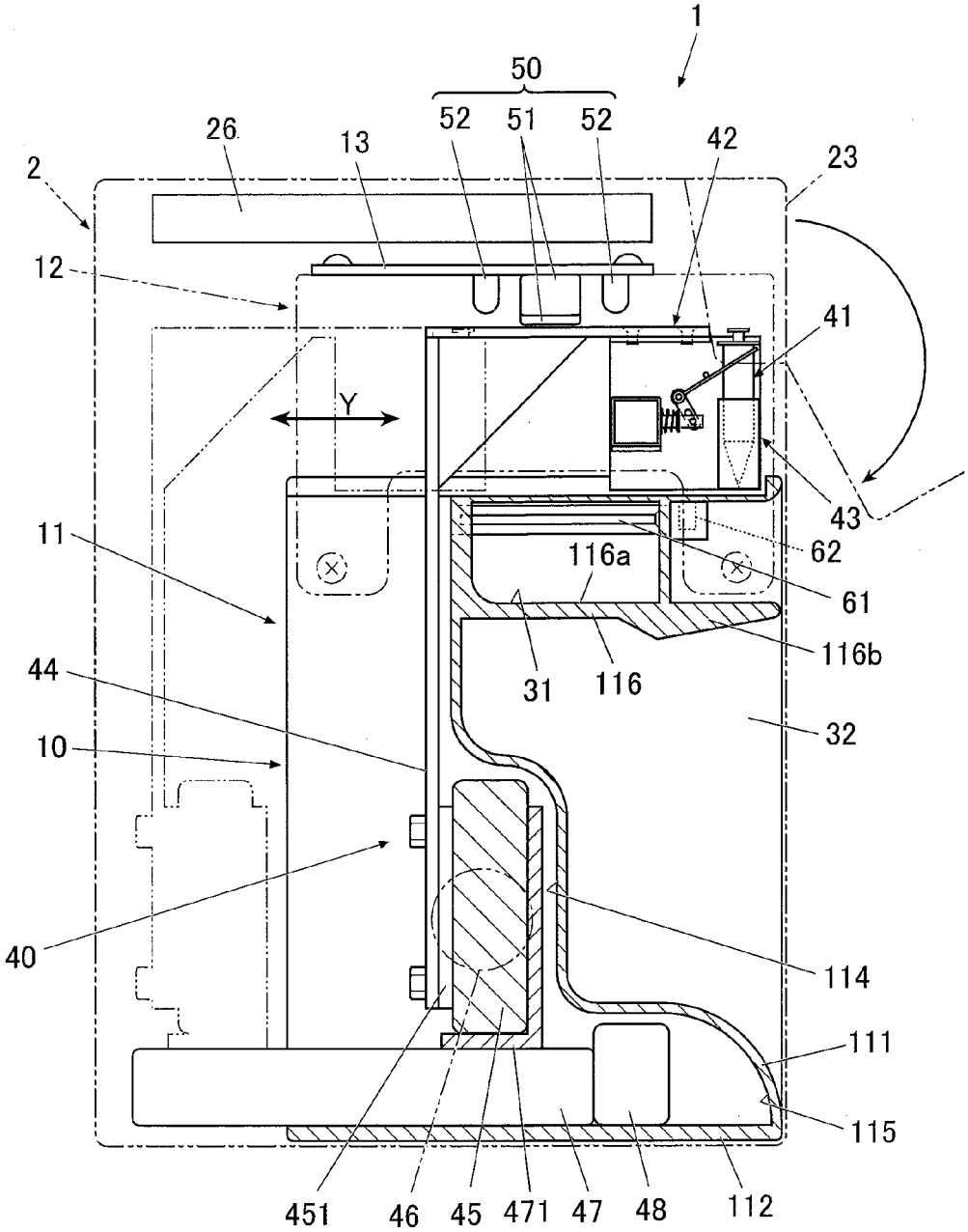
FIG. 2 is a sectional side view along the line II-II of FIG. 1.

FIG. 2 is a sectional side view along the line II-II of FIG. 1 and shows the internal structure of the drawing apparatus 1.

As shown in FIGS. 1 and 2, the drawing apparatus 1 is a nail printing apparatus which includes a case body 2 and an apparatus body 10 contained in the case body 2.

In FIGS. 1 and 2, the case body 2 is indicated by two-dot chain lines.

A cover 23 for drawing tool replacement is disposed at one end part of the upper front side of the case body 2. The cover 23 can be opened and closed so that drawing tools 41, such as pens, of a drawing unit 40, described later, can be replaced.

The cover 23 for drawing tool replacement can turn about a hinge, for example, from a closing state to an opening state as shown in FIG. 2.

One lateral face (left face in FIG. 1 in this embodiment) of the case body 2 has a medium insertion/output opening 24 at the position corresponding to a drawing tool warm-up section 61, which is described later. A drawing medium (not shown) placed on the drawing tool warm-up section 61 can be replaced through the medium insertion/output opening 24.

An operation unit 25 (see FIG. 6) is disposed on the upper surface (top board) of the case body 2.

The operation unit 25 is an input unit to receive various inputs from a user.

The operation unit 25 includes operation buttons (not shown) for various inputs, such as an electrical power switch button to power on the drawing apparatus 1, a stop switch button to stop its operation, a design selection button to select a design image to be drawn on nails, and a drawing start button to instruct start of drawing.

A display unit 26 is disposed on the upper surface (top board), almost in its center, of the case body 2.

The display unit 26 is constituted of a liquid crystal display (LCD), an organic electroluminescence display (organic EL), or another flat-panel display.

In the present embodiment, the display unit 26 displays nail images obtained by photographing a printing finger U1 (i.e., finger images each including the image of nail T), the image of the outline of the nail T included in the nail image, a design selection screen for selecting a design image to be drawn on a nail T, a thumbnail image for checking a design, an instruction screen to provide various instructions, and the like, as appropriate.

A touch panel may be integrally formed on the surface of the display unit 26. In this case, various selections and instructions can be made through touch operations of the surface of the touch panel with a fingertip, for example. A stylus pen and other stick writing implements having a sharp end may also be used for the touch operations of the surface of the display unit 26 for various inputs.

The apparatus body 10, which is substantially formed in the shape of a box, includes a lower machine casing 11 disposed at the lower part in the case body 2, and an upper machine casing 12 disposed above the lower machine casing 11 and at the upper part in the case body 2.

The lower machine casing 11 will now be described.

The lower machine casing 11 includes a back plate 111, a bottom plate 112, a pair of side plates 113*a* and 113*b*, an X-direction movement stage storage part 114, a Y-direction movement stage storage part 115, and a dividing wall 116.

The lower ends of the side plates 113*a* and 113*b* are connected to the both ends of the bottom plate 112, respectively, so that the side plates 113*a* and 113*b* are upright with respect to the bottom plate 112.

As shown in FIG. 2, the lower part of the back plate 111 is caved in two steps toward the front (i.e., near side in the finger insertion direction) to form recesses. The back plate 111, the bottom end of which is connected to the front end of the bottom plate 112, partitions the space enclosed by the bottom plate 112 and the side plates 113*a* and 113*b* into a front space and a back space.

The recessed spaces formed at the back of the back plate 111 are the X-direction movement stage storage part 114 and the Y-direction movement stage storage part 115 (see FIG. 2).

An X-direction movement stage 45 of a drawing unit 40 (see FIG. 6) fits in the X-direction movement stage storage part 114 when the drawing unit 40 moves forward (i.e., to the near side in the finger insertion direction).

A Y-direction movement stage 47 of the drawing unit 40 is disposed in the Y-direction movement stage storage part 115.

The dividing wall 116 is disposed in the lower machine casing 11 so as to vertically partition the front space inside the lower machine casing 11 (i.e., the space on the near side in the finger insertion direction enclosed by the back plate 111, the bottom plate 112 and the side plates 113*a* and 113*b*).

The dividing wall 116 lies substantially horizontally so that the left and right ends of the dividing wall 116 are connected to the side plates 113*a* and 113*b*, respectively, and so that the rear end of the dividing wall 116 is connected to the back plate 111.

The lower machine casing 11 is provided with a finger fixation section 30 integrally.

The finger fixation section 30 will now be described with reference to FIGS. 3, 4A, and 4B.

Figure 3:
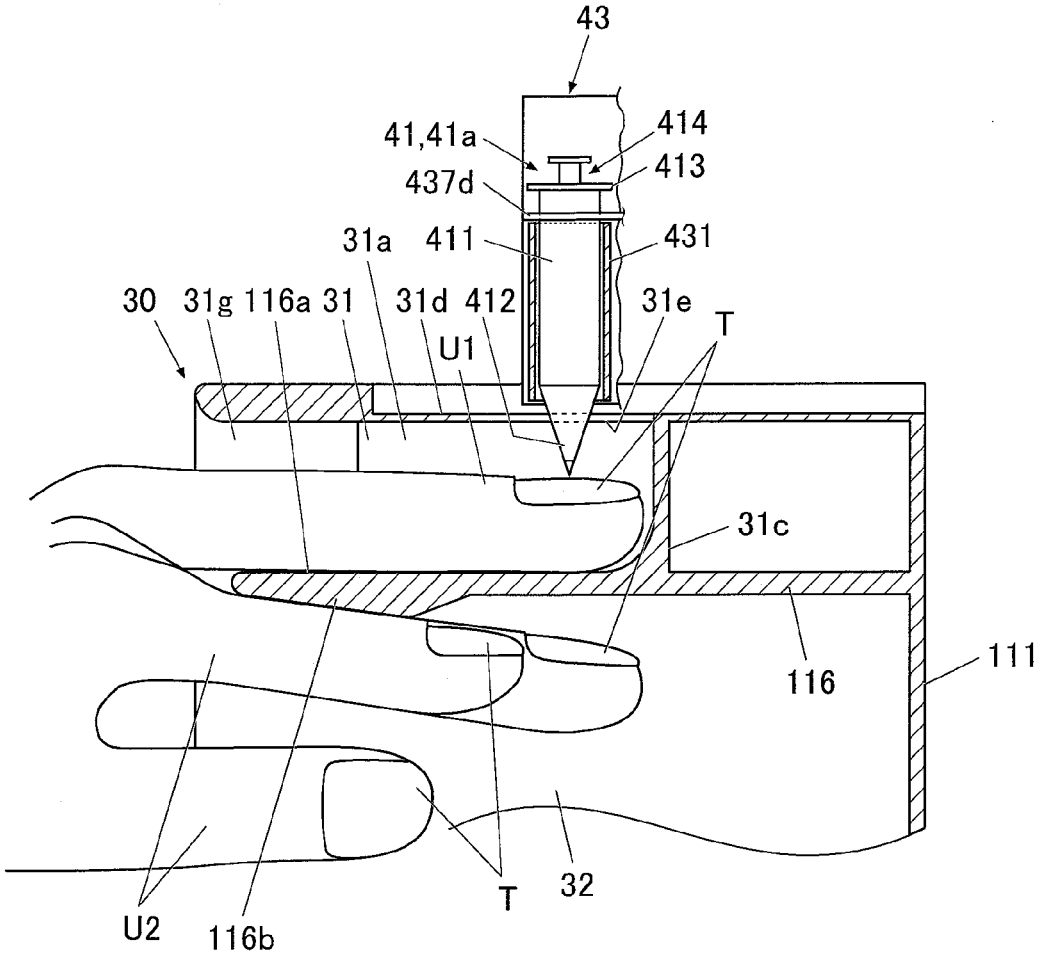
FIG. 3 is a sectional view along the line III-III of FIG. 1.

FIG. 3 is a sectional view, seen from the direction of the arrows, along the line III-III of FIG. 1.

Figure 4A:
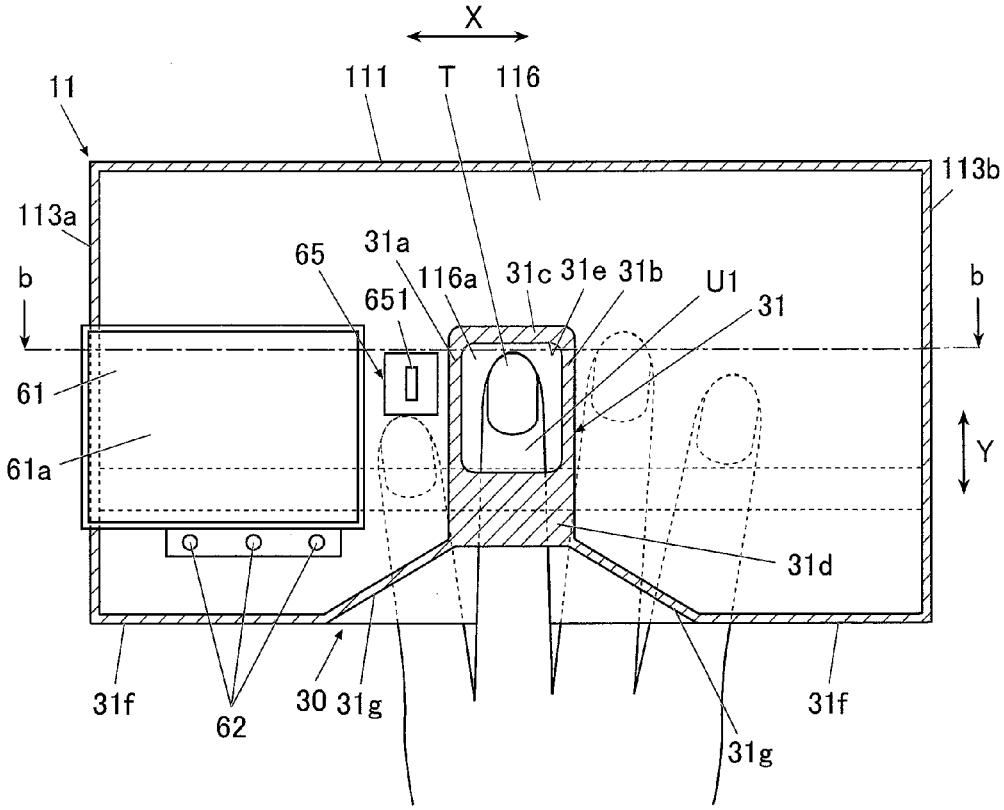
FIG. 4A is a horizontal sectional view of principal parts of the upper side of a dividing wall.

FIG. 4A is a top view of the dividing wall 116, with a part of the apparatus body 10 removed.

Figure 4B:
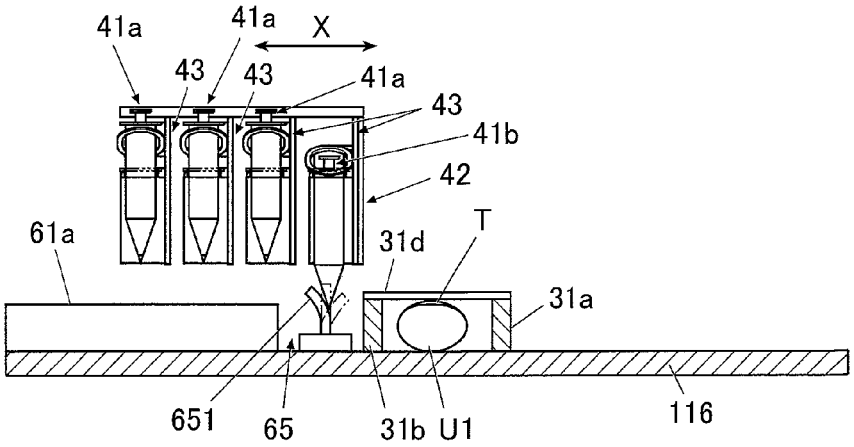
FIG. 4B is a schematic sectional view along the line b-b of FIG. 4A.

FIG. 4B is a schematic sectional view along the line b-b of FIG. 4A.

The finger fixation section 30 is constituted of a finger receiving section 31 and a finger escape section 32. The finger receiving section 31 is a section to receive a finger U1 with a nail T on which a drawing is to be made ("printing finger U1", hereinbelow), and the finger escape section 32 is a section where fingers U2 other than the printing finger U1 ("non-printing fingers U2", hereinbelow) are inserted.

The finger receiving section 31 is disposed over the dividing wall 116 and almost at the center of the lower machine casing 11 in its width direction. The lower space, formed by the dividing wall 116, of the lower machine casing 11 constitutes the finger escape section 32.

For example, when a drawing is to be made on the nail T of a ring finger as shown in FIG. 3, the ring finger as a printing finger U1 is inserted in the finger receiving section 31, while the other four fingers (i.e., the thumb and index, middle, and little fingers) as non-printing fingers U2 are inserted in the finger escape section 32.

The finger receiving section 31 opens toward the front side (i.e., near side in the printing finger insertion direction) of the lower machine casing 11 and is defined by a finger placement section 116*a* at the bottom which constitutes a part of the dividing wall 116, partitions 31*a* and 31*b* at the both sides (see FIGS. 4A and 4B), and a partition 31*c* at the back.

The finger placement section 116*a* allows a finger (printing finger U1) with a drawing target nail T to be placed on an X-Y plane.

The finger receiving section 31 is defined by the ceiling 31*d* at the top. The ceiling 31*d* has a window 31*e* through which the nail T of a printing finger U1 inserted in the finger receiving section 31 is exposed.

A front wall 31*f* which covers the front both-side parts of the lower machine casing 11 stands upright on the upper surface of the dividing wall 116 (see FIGS. 1 and 4).

A pair of guide walls 31*g* to guide a printing finger U1 into the finger receiving section 31 stands upright on the upper surface of the dividing wall 116. The guide walls 31*g* narrow from the end near the center of the front wall 31*f* toward the finger receiving section 31.

The dividing wall 116 can be held between a printing finger U1 inserted in the finger receiving section 31 and non-printing fingers U2 inserted in the finger escape section 32 by a user. Thus, a printing finger U1 inserted in the finger receiving section 31 can be stably fixed.

In this embodiment, the dividing wall 116 is provided with a bulge 116*b* bulging downward at the front end portion of the dividing wall 116.

The bulge 116*b* may form a taper portion whose thickness gradually decreases toward the near side and gradually increases toward the back as shown in FIG. 3. Alternatively, the entire thickness of the bulge 116*b* may be larger than that of the back part of the dividing wall 116.

Providing the bulge 116*b* at the front end portion of the dividing wall 116 in such a way creates an interspace between nails T of non-printing fingers U2 and the dividing wall 116 when the non-printing fingers U2 after drawing are inserted in the finger escape section 32. This can prevent the nails T from coming into contact with the bottom surface of the dividing wall 116 and thus prevent ink from adhering to the apparatus. Therefore, designs drawn on the nails T are prevented from being rubbed or spoiled.

As shown in FIGS. 4A and 4B, a drawing tool warm-up section 61 is provided on the upper surface of the dividing wall 116 beside the finger receiving section 31 (i.e., at the position corresponding to the medium insertion/output opening 24 of the case body 2, which is on the left side in FIG. 1 in this embodiment). The drawing tool warm-up section 61 is provided for drawing tools 41*a* (described later) to perform drawing for warm-up (or preparation for smooth drawing) within the region on which the drawing head 42 (described later) makes drawings.

Preferably, the drawing tool warm-up section 61 is substantially the same level as the nail T of a printing finger U1 inserted in the finger receiving section 31.

The drawing tool warm-up section 61 is a flat part on which a drawing medium (not shown) inserted through the medium insertion/output opening 24 of the case body 2 is placed.

Anything that enables warm-up (breaking-in) of pen tips 412 may be used as a drawing medium to be placed on the drawing tool warm-up section 61. For example, a slip of paper may be used.

The drawing tool warm-up section 61 is used for warm-up drawing to bring pen tips 412 in good condition before the start of image drawing based on image data on a nail T. Specifically, in the warm-up drawing, the drawing tools 41*a* are carried down to a drawing medium to draw predetermined figures, such as "o" and "∞". This prevents fuzzy lines at the beginning of the drawing due to drying of the pen tips 412 or a bad spread of ink.

The predetermined figure to be drawn for the warm-up drawing is not particularly limited, but preferably is a simple figure such as "o" and "∞" so as not to waste ink.

The figure, such as "o" and "∞", is preferably drawn at a position shifted a little each time of the warm-up drawing within the range of the drawing tool warm-up section 61.

When almost the entire drawing medium is filled with the drawn figures, the display unit 26 displays on the screen a message demanding replacement of a drawing medium, such as "replace paper". A user then takes the drawing medium out through the medium insertion/output opening 24 to replace it with a new one to allow warm-up drawing on the new drawing medium.

The drawing medium may be a roll of paper, for example. In this case, when there is no more space for drawing, the drawing medium of the roll paper is pulled out and warm-up drawing can be made on a new surface.

In this embodiment, drawing tool caps (drawing member caps) 62 made of rubber, for example, are disposed in front of the drawing tool warm-up section 61 (i.e., at the near side in the finger insertion direction) as shown in FIG. 4A.

The number of the drawing tool caps 62 is the same as the number of the drawing tools 41*a* attached to the drawing unit 40. In this embodiment, the number is three. When the drawing tools 41*a* attached to the drawing unit 40 do not perform drawing (non-drawing time), the pen tips 412 of the drawing tools 41*a* are fitted in the drawing tool caps 62.

The area of the drawing tool caps 62 is the home space (standby position) of the drawing tools 41*a* at the non-drawing time.

Specifically, at the non-drawing time, the drawing tools 41*a* are moved to the position just above the drawing tool caps 62, are carried down with solenoids 440 (see FIG. 5A, described later), and the pen tips 412 are fitted in the drawing tool caps 62. This prevents the pen tips 412 from drying at the non-drawing time.

The shape and other features of the drawing tool caps 62 are not limited to those described in the drawings. For example, a groove-like drawing tool cap to receive the pen tips 412 of all the drawing tools 41*a* attached to the drawing unit 40 may also be used.

In this embodiment, the drawing tool caps 62 are disposed beside the drawing tool warm-up section 61 as described above. In starting the drawing, the drawing tools 41*a* are lifted and perform warm-up drawing on the close-by drawing tool warm-up section 61, and then, regular drawing starts. This minimizes the time required for the movement of the drawing tools 41*a* and enables quick drawing.

As shown in FIGS. 4A and 4B, a cleaning mechanism 65 to clean the tip of a modification drawing tool 41*b*, which is described later, is disposed on the upper surface of the dividing wall 116 and between the home space where the drawing tool caps 62 are disposed (or the drawing tool warm-up section 61) and the drawing area where the finger receiving section 31 is disposed.

The cleaning mechanism 65 includes a blade 651 made of, for example, polyurethane (urethane resin).

The blade 651 is a contact member fixed at a position allowing the tip (first tip) of the modification drawing tool 41*b* (modification member) to come into contact with the blade 651. The blade 651 may be made of any material other than the example shown here but is preferably made of porous material having flexibility to some extent.

In this embodiment, the cleaning mechanism 65 touches the tip (first tip) of the modification drawing tool 41*b* (modification member) to clean the tip after a modification operation, which is described later.

Specifically, the tip of the modification drawing tool 41*b* comes into contact with the blade 651 while the modification drawing tool 41*b* is in motion. Foreign substance on the tip of the modification drawing tool 41*b*, if any, is thus removed. The modification drawing tool 41*b* may make one or more trips over the blade 651 so that the tip of the modification drawing tool 41*b* comes into contact with the blade 651 one or more times at the time of the cleaning operation.

The cleaning mechanism 65 may perform the cleaning at any timing. For example, the cleaning may be performed before the start of the modification of ink by the modification drawing tool 41*b*, an appropriate time after the start of the modification, or after the completion of the drawing.

To prevent mixture of ink colors and achieve a beautiful finish, the cleaning is preferably performed each time a series of movement of the modification drawing tool 41*b* is completed.

In this embodiment, the cleaning mechanism 65, which is disposed between the home space and the drawing area, can clean the modification drawing tool 41*b* while the drawing tools 41 are traveling between the home space and the drawing area at the start and end of drawing, for example. This minimizes the time required for the movement of the modification drawing tool 41*b* and enables efficient cleaning of the modification drawing tool 41*b*.

The blade 651 is preferably replaced when it has become dirty to some extent through the repeated cleaning. An opening is preferably provided, for example, over the cleaning mechanism 65 for the blade 651 to be replaced.

The drawing unit 40 includes the drawing head 42 including the drawing tools 41 for drawing, a unit support member 44 to support the drawing head 42, the X-direction movement stage 45 to move the drawing head 42 in the X direction (i.e., the X direction in FIG. 1 or the right-left direction of the drawing apparatus 1), an X-direction movement motor 46, the Y-direction movement stage 47 to move the drawing head 42 in the Y direction (i.e., the Y direction in FIG. 2 or the front-back direction of the drawing apparatus 1), and a Y-direction movement motor 48.

The drawing head 42 includes at least one modification drawing tool 41*b* (modification member) held thereon as a drawing tool 41. The drawing head 42 operates in such a way as to allow the first tip of the modification drawing tool 41*b* to touch the ink on the surfaces of nails T, as described later.

In this embodiment, the drawing head 42 further includes drawing tools 41*a* (drawing members) held thereon as drawing tools 41. The drawing head 42 operates in such a way as to allow the tips 412 (second tip) of the drawing tools 41*a* to touch the surfaces of nails T and to apply ink thereto.

In this embodiment, the drawing head 42 has four drawing tool carriages 43 to hold the respective drawing tools 41.

The drawing tools 41 include the drawing tools 41*a*, which have drawing function, and the modification drawing tool 41*b*, which does not have the drawing function but is used only for modification.

In this embodiment, "drawing tool (s) 41" includes both the drawing tools 41*a* and the modification drawing tool 41*b*.

The drawing tools 41*a* are the drawing members to apply ink to the surfaces of nails T to form a pattern on the nail surfaces according to a determined design.

Figure 5B:
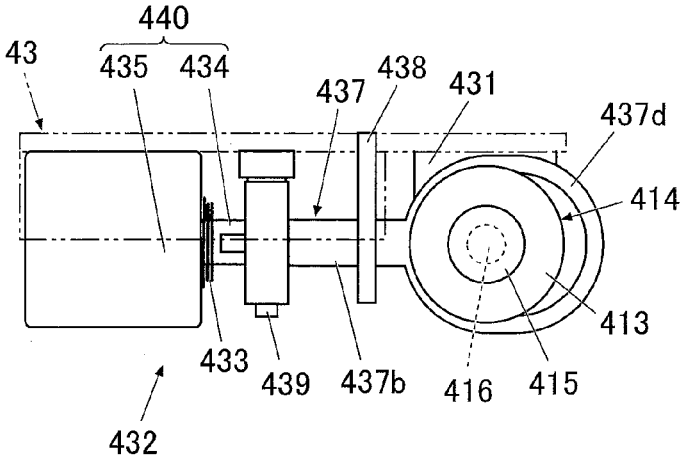
FIGS. 5A-5C are enlarged views of a drawing tool carriage and a drawing tool held by the drawing tool carriage in a drawing state, and more specifically.
Figure 5A:
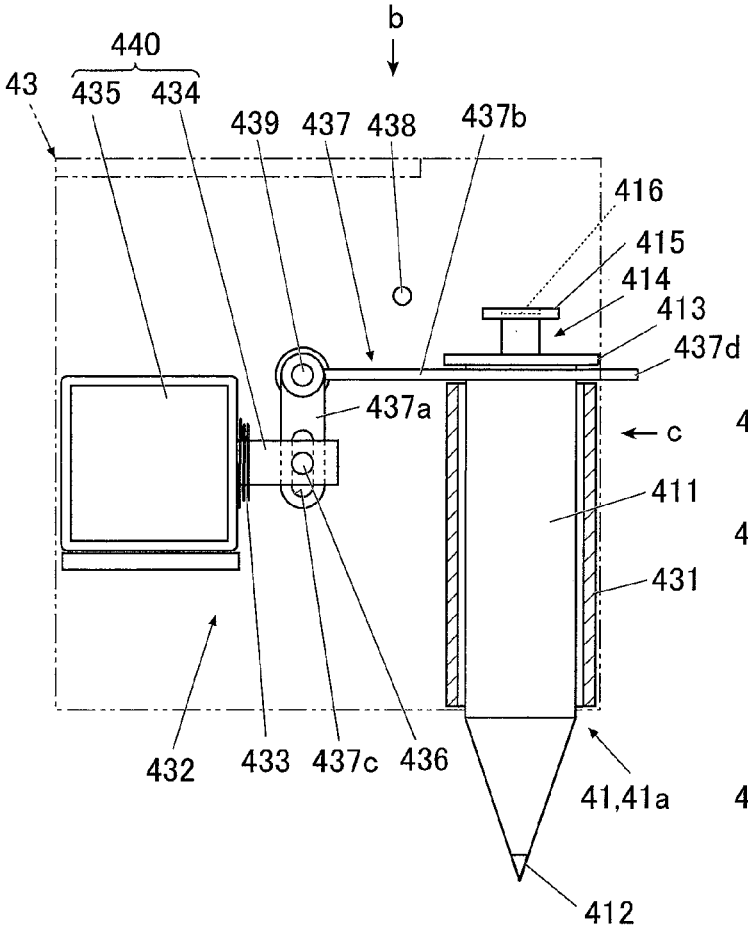
Figure 5C:
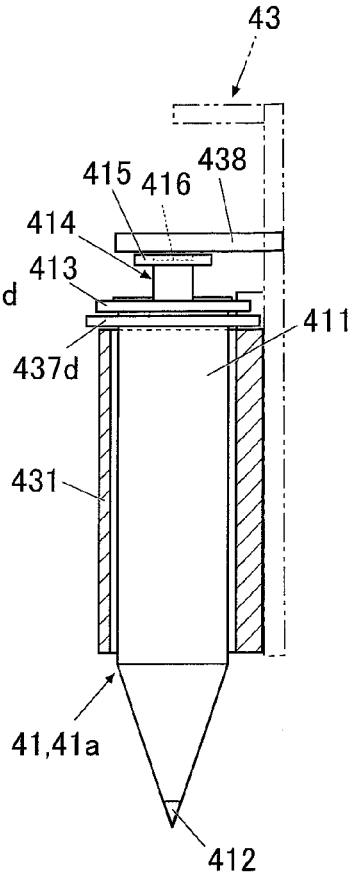

FIGS. 5A-5C are enlarged views of a drawing tool carriage 43 and a drawing tool 41*a* held by the drawing tool carriage 43 in the state in which drawing is performed (i.e., a drawing state).

FIG. 5A is a side view of a drawing tool carriage 43 and drawing tool 41*a*.

FIG. 5B is a top view obtained by viewing the drawing tool carriage 43 and drawing tool 41*a* of FIG. 5A from the arrow b.

FIG. 5C is a front view obtained by viewing the drawing tool carriage 43 and drawing tool 41*a* of FIG. 5A from the arrow c.

As shown in FIGS. 5A-5C, the drawing tool 41*a* held by each drawing tool carriage 43 has a pen shaft 411 and a pen tip 412 (second tip) disposed at an end of the pen shaft 411.

The interiors of the pen shafts 411 serve as ink containers to contain various types of ink.

The viscosity and particle diameter (or particle size) of coloring material of the ink contained in the pen shafts 411 are not particularly limited and various types of inks may be used.

For example, ink containing gold and silver glitter, white ink, UV-curable ink, material for gel nails, undercoats, topcoats, and nail polish may be used as the ink.

The ink may be a water-based ink containing acrylic synthetic polymer and water as main components. Examples of the water-based inks include an ink containing styrene/acrylates copolymer, water, and pigment.

Another example is a solvent ink containing cellulosic polymer and solvent as main components. Examples of the solvent inks include an ink containing nitrocellulose, butyl acetate, ethyl acetate, and pigment.

A lid 414 is attached to the other end of each pen shaft 411. The lid 414 is provided with a flange 413 protruding outward from the pen shaft 411.

The pen shafts 411 and the lids 414 may be made of any material, but resin is preferably used because it is suitable for mass production of the drawing tools 41*a*.

In this embodiment, the lid 414 is provided with a tab 415 at its upper part to be pinched with fingers or tweezers easily. A small piece of iron 416 is embedded in or adheres to the tab 415 to be attached to a magnet.

Each drawing tool 41*a* has a pen tip 412 of a ballpoint-pen type, for example, which allows the ink in the pen shaft 411 to come out through the pen tip 412 pressed against the surface of a nail T for drawing.

The drawing tool 41*a* is not limited to such a ballpoint-pen type, but may be a fiber-pen type which allows the ink to ooze through the felt pen tip for drawing, and a brush-pencil type which has a bundle of hair and performs drawing with the hair soaked with the ink. The pen tips 412 may have various shapes and thicknesses.

The types of the pen tips 412 of the drawing tools 41*a* held by the drawing tool carriages 43 may be the same as or different from one another.

Each drawing tool 41*a* is held by a drawing tool supporting part 437*d* and a drawing tool holder 431 of a drawing tool carriage 43, with the drawing tool 41*a* just inserted into the drawing tool supporting part 437*d* and the drawing tool holder 431 from above, as described later. The drawing tool 41*a* thus can be easily taken out to be replaced by opening the cover 23 for drawing tool replacement of the case body 2 and pinching the tab 415 with fingers or tweezers or bringing a stick (not shown) with a magnet at its tip close to the tab 415 for the magnet to attract the iron piece 416 to pull the drawing tool 41*a* up.

A user thus can replace the drawing tools 41*a* attached to the drawing tool carriages 43 with other drawing tools 41*a* having various types of pen tips 412 and inks as appropriate in accordance with a nail design to be drawn, achieving a wide variety of nail designs.

In this embodiment, four drawing tool carriages 43, each holding a drawing tool 41, are arranged in the width direction of the apparatus (i.e., the right-left direction or the X direction in FIG. 1). Accordingly, the positions of the pen tips 412 of the drawing tools 41*a* are different from one another in the X direction (or the right-left direction of the apparatus). The amount of difference in position is equal to the integral multiple of one step of the drawing operation. In performing drawing, the positions of the drawing tools 41*a* in the X direction are corrected by the number of steps corresponding to the amount of difference of the drawing tools 41*a* depending on the drawing tools 41*a* for use in the drawing. The four drawing tools 41, therefore, can make drawings at the same position.

Each of the drawing tool carriages 43 includes a drawing tool holder 431 to hold a drawing tool 41*a* substantially vertically, and a drawing tool up-and-down mechanism 432 to carry the drawing tool 41*a* up and down.

The drawing tool holder 431 is a cylindrical portion into which the pen tip 412 and the pen shaft 411 are inserted to hold the drawing tool 41*a*.

Each drawing tool up-and-down mechanism 432 includes a solenoid 440 including a plunger 434 and a coil 435, a pin 436 attached to the moving end part of the plunger 434 of the solenoid 440, a drawing tool up-and-down lever 437 connected to the plunger 434 through the pin 436, and a stopper 438 to prevent the drawing tool up-and-down lever 437 from moving up to a position exceeding the upper limit.

The plunger 434 moves back and forth like a piston in the coil 435 (wound copper wire) in the solenoid 440.

The plunger 434 is biased forward by a spring 433 (i.e., rightward in FIGS. 2 and 5A), and the solenoid 440 is a pull solenoid to pull the plunger 434 rearward (i.e., leftward in FIGS. 2 and 5A) against the biasing force of the spring 433. The solenoid 440 may be a push solenoid instead of the pull solenoid.

As shown in FIG. 5A, the drawing tool up-and-down lever 437 is an L-shaped member having a short arm 437*a* and a long arm 437*b* substantially perpendicular to each other. The short arm 437*a* has a long hole 437*c* at its end part. The long hole 437*c* is engaged with the pin 436.

The long arm 437*b* has a drawing tool supporting part 437*d* at its end part into which a drawing tool 41*a* is to be inserted.

The drawing tool supporting part 437*d* is in the shape of a ring having an inner diameter larger than those of the pen shaft 411 and pen tip 412 of the drawing tool 41*a*, and smaller than that of the flange 413 of the drawing tool 41*a*. The pen shaft 411 and pen tip 412 are inserted into the drawing tool supporting part 437*d*, and the drawing tool supporting part 437*d* catches the flange 413 so as to support the flange 413 from below.

The rotation axis 439 is inserted in the intersection of the short arm 437*a* and the long arm 437*b* of the drawing tool up-and-down lever 437, the rotation axis 439 being fixed at the drawing tool carriage 43 side.

In this embodiment, when the solenoid 440 is being driven, the plunger 434 is pulled rearward against the biasing force of the spring 433 as shown in FIG. 5A. At this time, the drawing tool up-and-down lever 437 engaged with the pin 436 of the plunger 434 is kept in such a way that the long arm 437*b* is almost horizontally positioned.

In this state, the tip 412 of the drawing tool 41*a* is below the drawing tool holder 431 of the drawing tool carriage 43 and can touch the surface of a nail T or a drawing medium, which is a drawing state.

When the solenoid 440 is off, the biasing force of the spring 433 pushes the plunger 434 forward. At this time, the drawing tool up-and-down lever 437 engaged with the pin 436 of the plunger 434 rotates upward (i.e., in the counter-clockwise direction) with the rotation axis 439 as a pivot point until the long arm 437*b* touches the stopper 438 and stops.

In this way, the drawing tool up-and-down lever 437 brings the flange 413 of the drawing tool 41*a* upward (see FIG. 2). In this state, the tip 412 of the drawing tool 41*a* is above the drawing tool holder 431 of the drawing tool carriage 43 and does not touch the surface of a nail T or a drawing medium, which is a non-drawing state.

In this way, the force to move the plunger 434 back and forth produced by the solenoid 440 is converted to the force to move the drawing tool 41*a* up and down through the rotation axis 439 and the drawing tool up-and-down lever 437 rotating about the rotation axis 439.

The drawing tool 41*a* is just inserted in the drawing tool holder 431 of the drawing tool carriage 43 but is not fixed to the drawing tool up-and-down lever 437 etc. This allows the drawing tool 41*a* to be biased downward for its own weight.

The drawing tool 41*a* thus can freely go down the drawing tool holder 431 until the flange 413 comes into contact with the upper surface of the drawing tool supporting part 437*d*, and when the pen tip 412 touches the surface of a nail T or a drawing medium, the pen tip 412 presses the surface of the nail T or the drawing medium.

In other words, when the drawing tool 41*a* makes a drawing on a nail T, the pen tip 412 can freely move in the Z direction (i.e., vertical direction) perpendicular to the X-Y plane, on which a printing finger U1 is placed, along the shape (ups and downs) of the surface of the nail T in accordance with the curve and height of the nail T.

For example, when a drawing is to be made on a low area of a nail T (for example, the both-end parts of a nail T in its width direction), a drawing tool 41*a* comes down almost to such a position as the flange 413 touches the upper surface of the drawing tool supporting part 437*d*. On the other hand, when a drawing is to be made on a high area of a nail T (for example, the center part of a nail T in its width direction), a drawing tool 41*a* goes up in accordance with the level of the nail T and the flange 413 goes away from the upper surface of the drawing tool supporting part 437*d*.

The drawing tool 41*a* is light in weight, e.g., several grams to several tens of grams, and a user does not feel a pain when a pen tip 412 touches a nail T. The weight of the drawing tool 41*a*, however, applies an enough pen pressure, enabling production of excellent nail designs on nails T.

In this embodiment, the rotation axis 439 and the stopper 438 are made of metal, such as stainless-steel; and the other members constituting the drawing tool up-and-down mechanism 432 are made of material, such as resin, which is light in weight and does not react with a magnet. The materials of the members constituting the drawing tool up-and-down mechanism 432 are not limited to those shown above.

The solenoids 440 are used as actuators to move the drawing tools 41*a* up and down in this embodiment. The actuators to move the drawing tools 41*a* up and down, however, are not limited to the solenoids 440.

Since the drawing tools 41*a* are light in weight, the actuators to move the drawing tools 41*a* up and down may be constituted of various types of compact driving devices, instead of the solenoids.

The modification drawing tool 41*b* is a modification member whose tip is to touch the ink on the surface of a nail T for a modification operation. Specifically, in the modification operation, the modification member is moved while its tip is touching the ink that has been applied to the surface of nail T but has not been dried or cured. Such an operation transfers a part of the undried or uncured ink to modify a part of the pattern formed with the ink.

The modification drawing tool 41*b* is, for example, a wooden stick like a toothpick or a thin brush.

The modification drawing tool 41*b* may be made of any material that does not have a risk of damaging nails T and fingers.

FIG. 1 and other drawings show an example of the four drawing tools 41 including only one modification drawing tool 41*b*, but more than one modification drawing tools 41*b* may be included. For example, a plurality of modification drawing tools 41*b* having different types of tips (first tips), such as a wooden stick, a thin brush, and a flat brush, may be provided. In this case, an appropriate one of the modification drawing tools 41*b* can be selected according to a nail design.

Unlike the drawing tools 41*a*, the modification drawing tool 41*b* does not have an ink container to store ink therein. The modification drawing tool 41*b*, however, may have the same external shape as each drawing tool 41*a* except for the shape of the tip (a first tip for the modification drawing tool 41*b*, and a second tip for each drawing tool 41*a*). Specifically, mechanisms for holding the modification drawing tool 41*b* with the drawing tool carriage 43 and for moving the modification drawing tool 41*b* up and down may be the same as those for each drawing tool 41*a*.

In this embodiment, the external shape of the modification drawing tool 41*b* and that of each drawing tool 41*a* are the same, except for the external shape of tip; and the mechanisms for holding and moving up and down the modification drawing tool 41*b* is the same as that for each drawing tool 41*a*. The explanations for the common mechanisms therefore are omitted here.

The unit support member 44 supporting the drawing head 42 is fixed to an X-direction movement section 451 attached to the X-direction movement stage 45.

The X-direction movement motor 46 drives the X-direction movement section 451 to move in the X direction along a guide (not shown) on the X-direction movement stage 45. This allows the drawing head 42 to move in the X direction (i.e., the X direction in FIG. 1 or the right-left direction of the drawing apparatus 1).

The X-direction movement stage 45 is fixed to the Y-direction movement section 471 of the Y-direction movement stage 47.

The Y-direction movement motor 48 drives the Y-direction movement section 471 to move in the Y direction along a guide (not shown) on the Y-direction movement stage 47. This allows the drawing head 42 to move in the Y direction (i.e., the Y direction in FIG. 2 or the front-back direction of the drawing apparatus 1).

In this embodiment, the X-direction movement stage 45 and the Y-direction movement stage 47 are constituted of the combination of the X-direction movement motor 46, the Y-direction movement motor 48, ball screws (not shown), and guides (not shown).

The X-direction movement motor 46 and the Y-direction movement motor 48 in this embodiment are step motors which make a predetermined amount of movement for each pulse.

In this embodiment, the X-direction movement motor 46, the Y-direction movement motor 48 and the like constitute a head drive section 49 (see FIG. 6) as a movement mechanism to move the drawing head 42 including the drawing tools 41 in the X and Y directions.

The solenoids 440 to move the drawing tools 41 of the drawing unit 40 up and down, the X-direction movement motor 46, and the Y-direction movement motor 48 are connected to a drawing controller 815 of a control device 80 (see FIG. 6, described later) to be controlled by the drawing controller 815.

As shown in FIGS. 1 and 2, the photographing unit 50 is disposed on the upper machine casing 12.

A substrate 13 is disposed on the upper machine casing 12, and two cameras 51 as photographing devices are disposed at the center of the lower surface of the substrate 13.

The cameras 51 preferably have about two million pixels or more.

The cameras 51 photograph the nail T of a printing finger U1 inserted in the finger receiving section 31 to obtain nail images (i.e., finger images each including the image of the nail T), which are the images of the nail T of the printing finger U1.

In this embodiment, the two cameras 51 are arranged substantially side by side in the width direction of the nail T of a printing finger U1 inserted in the finger receiving section 31.

One of the two cameras 51 faces the bottom face of the finger receiving section 31 to photograph a nail T from just above.

The other of the two cameras 51 is slightly tilted with respect to the bottom face of the finger receiving section 31 to photograph the nail T from diagonally above.

The substrate 13 is provided with illuminators (illuminating devices) 52, such as white LEDs, disposed in such a way as to surround the cameras 51. The illuminators 52 illuminate the nail T of a printing finger U1 at the time of the photographing by the cameras 51.

The photographing unit 50 is constituted of the cameras 51 and the illuminators 52.

The photographing unit 50 is connected to a photographing controller 811 of the control device 80 (see FIG. 6, described later) to be controlled by the photographing controller 811.

The image data of images obtained by the photographing unit 50 is stored in a nail image storage area 821 of a storage unit 82, described later.

In this embodiment, two cameras 51 as photographing devices photograph a nail T from at least two different positions or angles to obtain at least two nail images.

A nail information detector 812 (described later) detects nail information, such as the contour (shape) of a nail T, inclination angle of the surface of a nail T with respect to the X-Y plane (hereinafter referred to as "inclination angle of a nail T" or "nail curvature"), and the vertical position of a nail T, on the basis of the nail images.

Taking the images of a nail T from just above and from diagonally above the nail T enables accurate detection of the position of the nail T and inclination angle of the surface of the nail T as well as the contour of the nail T.

The apparatus does not necessarily have to include two cameras 51 as photographing devices to detect the inclination angle or curvature of nails T. The apparatus may photograph a nail T only from just above the nail T just to detect the contour (shape) of the nail T as nail information.

The control device 80 is disposed on the substrate 13 on the upper machine casing 12, for example.

Figure 6:
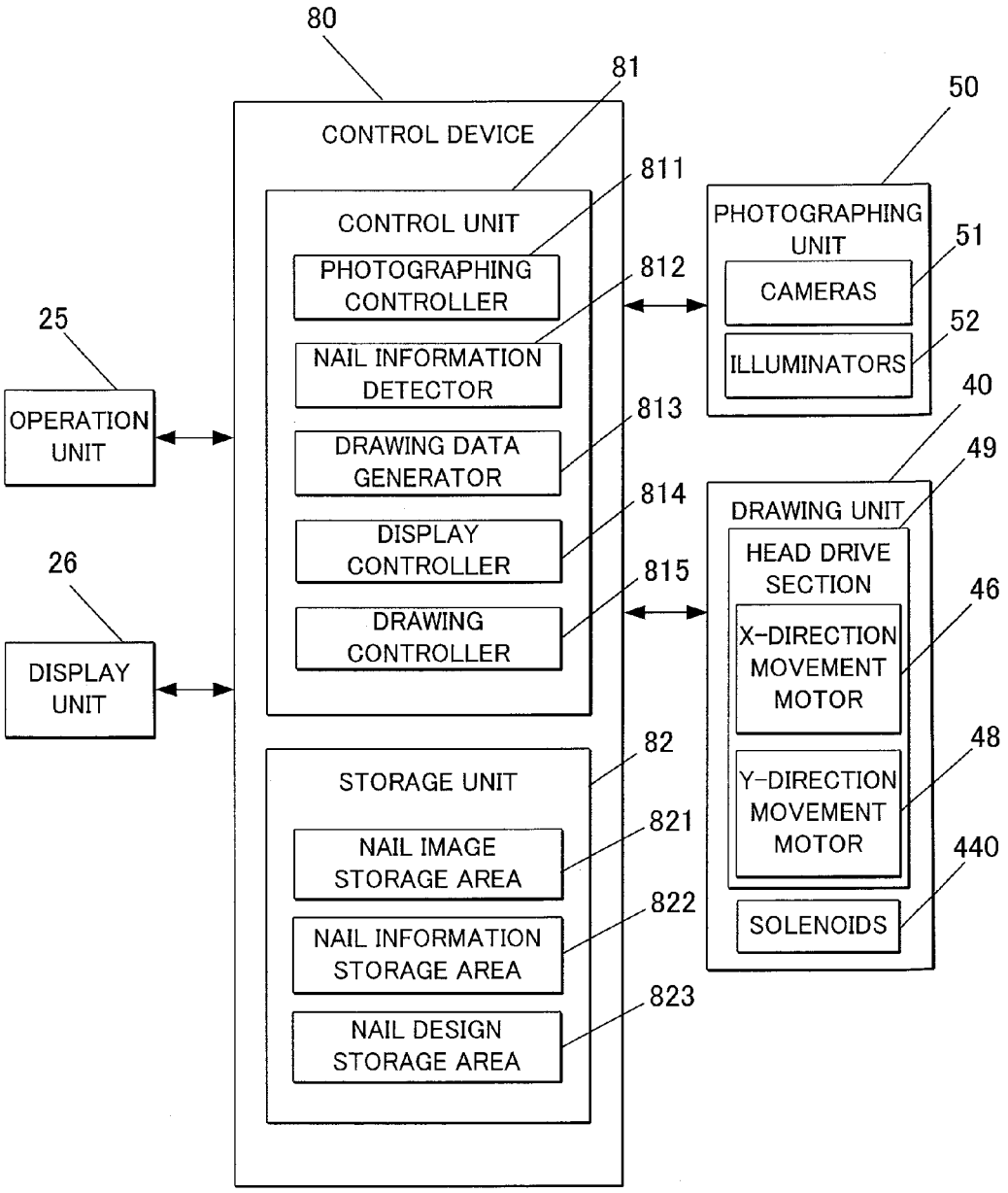
FIG. 6 is a block diagram showing the principal control configuration of the drawing apparatus according to this embodiment.

FIG. 6 is a block diagram showing the principal control configuration in this embodiment.

As shown in FIG. 6, the control device 80 is a computer including a control unit 81 constituted of a central processing unit (CPU), and a storage unit 82 constituted of a read only memory (ROM) and a random access memory (RAM), for example (the CPU, ROM and RAM are not shown).

The storage unit 82 contains various programs and various pieces of data for the operation of the drawing apparatus 1.

Specifically, the ROM of the storage unit 82 contains various programs, such as a nail information detection program to detect nail information, such as the shape of a nail T, from nail images; a drawing data generation program to generate drawing data; and a drawing program to perform drawing processing. Each unit of the drawing apparatus 1 is comprehensively controlled through the execution of these programs by the control device 80.

In this embodiment, the storage unit 82 includes a nail image storage area 821, a nail information storage area 822, and a nail design storage area 823. The nail image storage area 821 stores nail images of the nail T of a user's printing finger U1 obtained by the photographing unit 50. The nail information storage area 822 stores the nail information detected by the nail information detector 812. The nail design storage area 823 stores the image data of nail designs to be drawn on nails T.

In this embodiment, the image data of nail designs stored in the nail design storage area 823 includes the image data of basic designs to be drawn by the drawing tools 41*a* and the modification data for the modification operation to be performed with the modification drawing tool 41*b*.

Figure 8A:
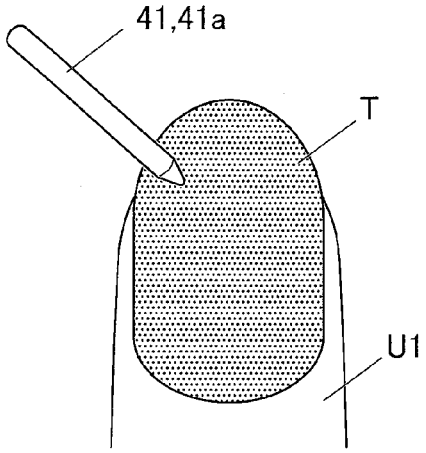
FIG. 8A shows a state in which a base color has been applied to a nail.
Figure 8D:
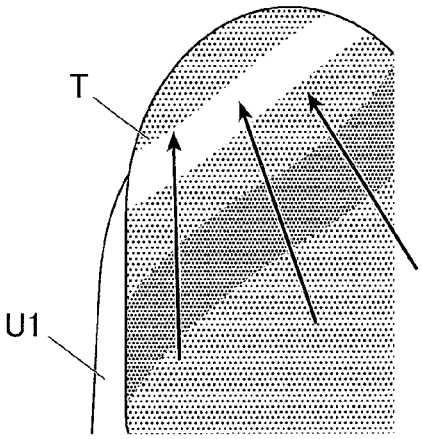
FIG. 8D shows the modification direction of a modification operation.
Figure 8B:
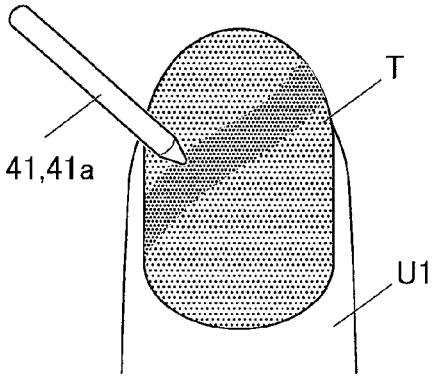
FIG. 8B shows a state in which one line has been drawn on the base color of FIG. 8A.
Figure 8E:
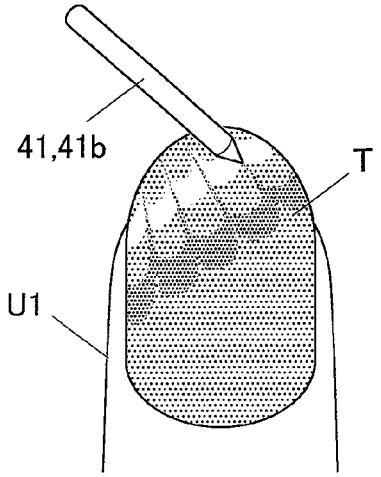
FIG. 8E shows a state in which modification is being made to the state of FIG. 8C.
Figure 8C:
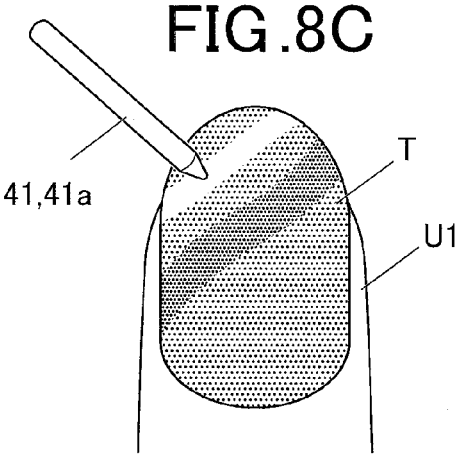
FIG. 8C shows a state in which another line has been drawn on FIG. 8B.
Figure 9A:
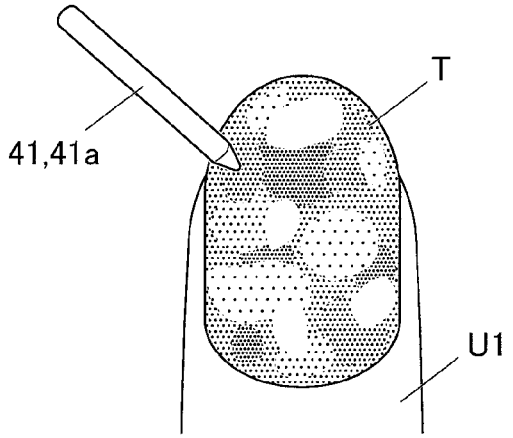
FIG. 9A shows a state in which dot pattern have been drawn on a nail.

The image data of each basic design includes the data of a base color to be applied to the entire nail surface and includes the data of line pattern and dot pattern etc. to be drawn on the base color (see, for example, FIGS. 8C and 9A).

The modification data includes the information of the moving direction and moving distance of the tip (first tip) of the modification drawing tool 41*b*.

Specifically, the modification data includes the coordinate information of the modification starting position from which the modification by the modification drawing tool 41*b* starts, the vector information indicating the moving distance and moving direction from the modification starting position, and the like.

In this embodiment, the nail design storage area 823 of the storage unit 82 serves as a storage unit to store the modification data for each design.

The modification data is prepared in association with the image data of the basic design for each nail design.

In the case in which the apparatus includes a plurality of types of modification drawing tools 41*b* having tips different from one another in shape and an appropriate one of the tools 41*b* is selected according to a desired nail design, the modification data further includes the information indicating which type of tip of modification drawing tool 41*b* is to be used.

The control unit 81 includes the photographing controller 811, the nail information detector 812, the drawing data generator 813, the display controller 814, and the drawing controller 815, in terms of its function. The functions as the photographing controller 811, the nail information detector 812, the drawing data generator 813, the display controller 814, and the drawing controller 815 are carried out through cooperation between the CPU of the control unit 81 and the programs stored in the ROM of the storage unit 82.

The photographing controller 811 controls the cameras 51 and the illuminators 52 of the photographing unit 50 so that the cameras 51 take finger images each including the image of the nail T of a printing finger U1 inserted in the finger receiving section 31 (hereinafter referred to as "nail images").

In this embodiment, the photographing controller 811 allows the two cameras 51 to obtain at least two nail images from different positions or angles (e.g., from just above a nail T and diagonally above the nail T).

The image data of nail images obtained by the photographing unit 50 is stored in the nail image storage area 821 of the storage unit 82.

The nail information detector 812 detects the nail information on the nail T of a printing finger U1 on the basis of the images of the nail T of the printing finger U1 inserted in the finger receiving section 31 obtained by the cameras 51.

The nail information includes the information on the contour of a nail T (i.e., the shape or the horizontal position of a nail T), the inclination angle of the surface of a nail T with respect to the X-Y plane (i.e., the inclination angle of a nail T or nail curvature), the height of a nail T (i.e., the position of a nail T in the vertical direction; hereinafter referred to as "vertical position of a nail T" or simply as "the position of a nail T").

The inclination angle of a nail T (or nail curvature) refers to the angle with respect to the horizontal plane in the width direction of the nail T (i.e., with respect to the X-Y plane of the finger placement section 116*a* on which the printing finger U1 is placed).

Specifically, the nail information detector 812 detects the contour (shape and size) and position of the nail T from the images of the nail T of a printing finger U1 obtained by the cameras 51. Thus, the contour is acquired as the information represented by X-Y coordinates, for example.

For example, the nail information detector 812 detects the contour (shape) of a nail T on the basis of the difference in color between the nail T and the other part of the finger, from the nail images of the nail T of the printing finger U1 obtained by the cameras 51.

The method to detect the contour (shape) of a nail T is not limited to the example shown here, but the nail information detector 812 may use any other method.

The nail information detector 812 serves as an inclination angle detector that detects the inclination angle of a nail T (nail curvature) on the basis of at least two nail images obtained by the two cameras 51.

The nail information detector 812 detects the inclination angle (curvature) of a user's nail T from the two nail images taken by the two cameras 51 from different positions or angles (e.g., from just above and diagonally above the nail T).

The method to detect the inclination angle of a nail T (nail curvature) is not limited to the example shown here, but the nail information detector 812 may use any other method.

The nail information detector 812 has only to detect at least the contour (shape) of a nail T based on a nail image but does not necessarily have to acquire all of the nail information described above.

The drawing data generator 813 generates drawing data of the drawing to be applied to the nail T of a printing finger U1 by the drawing head 42 on the basis of the nail information detected by the nail information detector 812.

Specifically, the drawing data generator 813 performs a fitting process such as expansion or reduction in size or clipping of the image data of a nail design on the basis of the shape of a nail T detected by the nail information detector 812 to generate drawing data of the drawing to be applied to the nail T.

In this embodiment, the drawing data generator 813 performs curved surface correction on the image data of a nail design in accordance with the inclination angle of a nail T (nail curvature) if the inclination angle (nail curvature) is obtained as nail information by the inclination angle detector 812.

The display controller 814 controls the display unit 26 to display various screens on the display unit 26.

In this embodiment, the display controller 814 controls the display unit 26 to display various screens, such as a selection screen to allow selection of a nail design, a thumbnail image for confirmation of a design, and nail images obtained by the photographing of a printing finger 131.

The drawing controller 815 outputs drawing data generated by the drawing data generator 813 to the drawing unit 40 and controls the solenoids 440, the X-direction movement motor 46, and the Y-direction movement motor 48 of the drawing unit 40 to make a drawing based on the drawing data on a nail T.

In this embodiment, the drawing controller 815 allows the drawing tools 41*a* to draw a basic design on the surface of a nail T on the basis of the image data of the basic design.

Specifically, the drawing controller 815 allows the head drive section 49, i.e., a movement mechanism, to move each drawing tool 41*a* through the drawing head 42 while the drawing head 42 keeps the pen tip 412 (second tip) of the drawing tool 41*a* in contact with the surface of the nail T. The drawing controller 815 thus controls the drawing operation for forming a pattern on the surface of the nail T.

After the drawing of the basic design with ink has been completed but before the ink has been dried or cured, the drawing controller 815 moves the modification drawing tool 41*b* while the tip of the modification drawing tool 41*b* is touching the undried or uncured ink on the surface of the nail T on the basis of modification data. This operation transfers a part of the ink and modifies the basic design.

Specifically, the drawing controller 815 allows the head drive section 49, i.e., a movement mechanism, to move the modification drawing tool 41*b* through the drawing head 42 on the basis of the modification data to bring the tip (first tip) of the modification drawing tool 41*b* into contact with the point, identified by the modification data, on the ink on the surface of the nail T.

The drawing controller 815 then controls the head drive section 49 to move the modification drawing tool 41*b* through the drawing head 42 on the basis of the modification data while the tip of the modification drawing tool 41*b* is in contact with the ink. The movement of the tip of the modification drawing tool 41*b* transfers a part of the ink.

The drawing controller 815 thus controls the modification operation for modifying a part of the pattern that has been formed with the ink on the surface of the nail T.

In the case in which the apparatus includes a plurality of types of modification drawing tools 41*b* having tips different from one another in shape and an appropriate one of the tools 41*b* is selected according to a desired nail design, the drawing controller 815 selects a modification drawing tool 41*b* to be used according to the modification data and modifies the basic design by operating the selected modification drawing tool 41*b* on the basis of the modification design.

At the time of a cleaning operation, the drawing controller 815 allows the head drive section 49, i.e., a movement mechanism, to move the modification drawing tool 41*b* in such a way that the tip (first tip) of the modification drawing tool 41*b* passes the position where the tip (first tip) comes into contact with the blade 651 (contact member).

Figure 7:
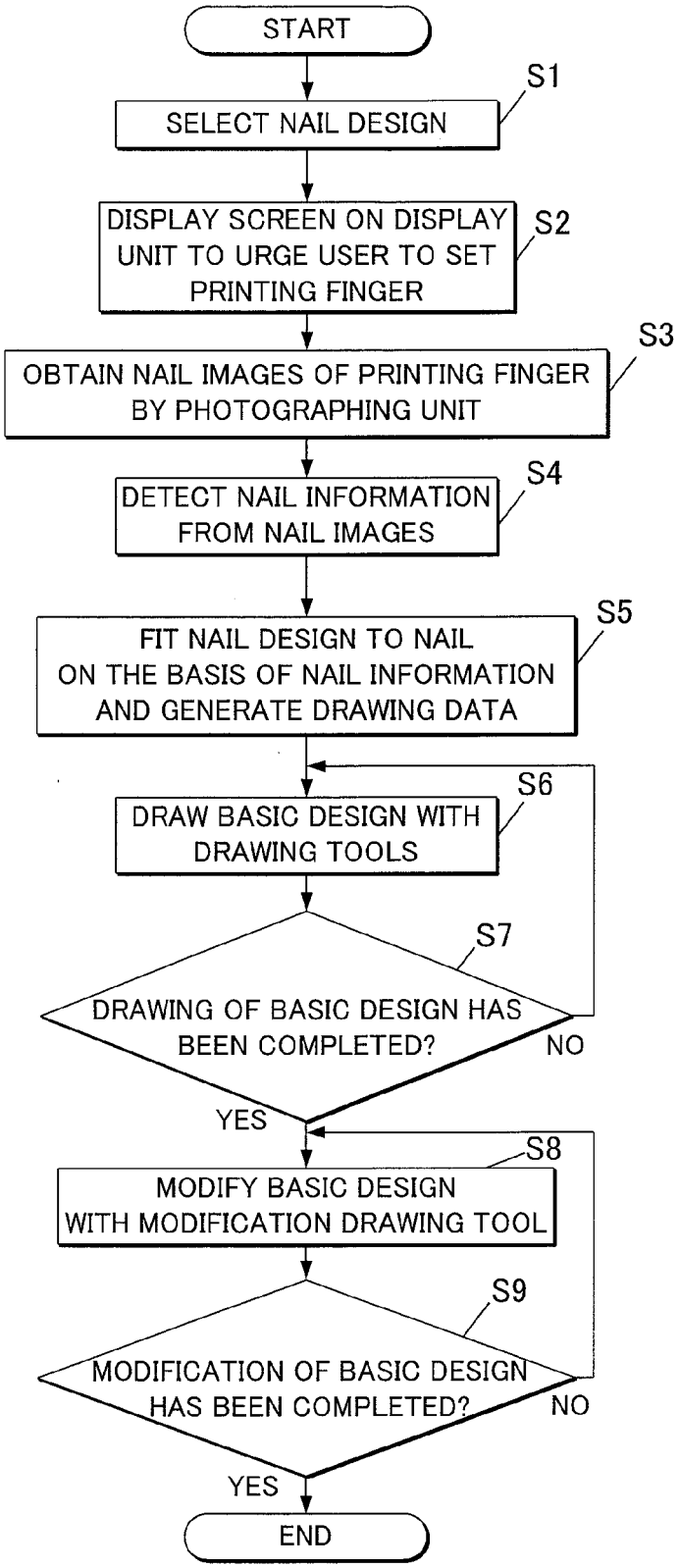
FIG. 7 is a flowchart showing a drawing process of the drawing apparatus of this embodiment.

The operation of the drawing apparatus 1 and the method for drawing in this embodiment will now be described with reference to FIG. 7. In this embodiment, the modification operation to modify a basic design is performed.

In performing the drawing with the drawing apparatus 1, a user first operates the electrical power switch button of the operation unit 25 to start the control device 80.

The display controller 814 controls the display unit 26 to display the design selection screen.

The user operates the design selection button of the operation unit 25, for example, and selects a desired nail design among a plurality of nail designs displayed on the design selection screen.

This causes the operation unit 25 to output a selection instruction signal so that a nail design to be drawn on a nail T is selected (Step S1).

Upon selection of a nail design, the control unit 81 allows the display unit 26 to display an instruction screen urging a user to attach drawing tools 41 required for drawing the selected nail design to predetermined drawing tool carriages 43 of the drawing head 42. The drawing tools 41 include the drawing tool (s) 41*a* and the modification drawing tool 41*b*.

When red ink and ink containing gold glitter are needed, for example, the control unit 81 gives instructions through the display unit 26 about which drawing tools 41*a* are to be attached to which drawing tool carriages 43.

A user attaches predetermined types of drawing tools 41 to predetermined drawing tool carriages 43 in accordance with the instructions displayed on the screen. Alternatively, a user may dare to attach drawing tools 41 different from the instructions to create a nail design with desired colors and texture.

The information on which drawing tools 41 are attached to which drawing tool carriages 43 may be read by the control unit 81 using a bar code, for example. In this case, nail designs which can be created with the drawing tools 41 attached to the drawing tool carriages 43 may be displayed on the design selection screen of the display unit 26 so that a user can select one of the nail designs.

Next, control unit 81 allows the display unit 26 to display an instruction screen urging the user to insert a printing finger U1 in the finger receiving section 31 (Step S2).

According to this instruction, the user inserts a printing finger U1 in the finger receiving section 31 and inserts non-printing fingers U2 in the finger escape section 32 so as to fix the printing finger U1. The user then operates a drawing switch button in this state.

In FIG. 3, for example, the left ring finger is inserted in the finger receiving section 31 as a printing finger U1, and the other fingers are inserted in the finger escape section 32 as non-printing fingers U2.

Before the start of a drawing operation, the photographing controller 811 controls the photographing unit 50 so that the cameras 51 photograph the printing finger U1 while the illuminators 52 illuminate the printing finger U1 in response to an instruction input from the drawing switch button.

The photographing unit 50 thus obtains the images (nail images) of the nail T of the printing finger U1 inserted in the finger receiving section 31 (Step S3).

Next, the nail information detector 812 detects nail information, such as the contour (shape) of the nail T on the basis of the nail images (Step S4).

After the nail information detector 812 detects the nail information, such as the contour (shape) of the nail T, the drawing data generator 813 performs the fitting process to fit the image data of the nail design to the nail T on the basis of the nail information. The drawing data generator 813 then performs the curved surface correction on the image data of the nail design on the basis of the nail information as appropriate. Thus, drawing data is generated (Step S5).

Before the start of the drawing on the nail T, the drawing controller 815 moves the drawing unit 40 to the position above the drawing tool warm-up section 61, and drives the solenoids 440 of the drawing tool carriages 43 holding the drawing tools 41*a* so that the drawing tools 41*a* are ready for drawing.

The warm-up drawing is then performed on a drawing medium by drawing predetermined figures such as "o" and "∞".

The warm-up drawing may be performed by only the drawing tools 41*a* required to draw a selected nail design or alternatively may be performed by all the drawing tools 41*a*.

After the generation of the drawing data and the completion of the warm-up drawing, the drawing controller 815 outputs the drawing data to the drawing unit 40.

The drawing controller 815 then drives the solenoids 440 of the drawing tool carriages 43 holding the drawing tools 41*a* required for the drawing so that the drawing tools 41*a* are ready for drawing.

The drawing controller 815 moves the drawing head 42 in X and Y directions as appropriate on the basis of the image data of the basic design included in the drawing data, to draw the basic design on the nail T (Step S6).

Each drawing tool 41*a* is pressed against the surface of the nail T due to its own weight and draws the design while moving up and down along the shape of the surface of the nail T.

The drawing controller 815 determines whether the drawing of the basic design has been completed (Step S7).

If determining that the drawing of the basic design has not been completed (Step S7; NO), the drawing controller 815 returns to Step S6 and repeats the process until the drawing of the basic design is completed.

If determining that the drawing of the basic design with ink has been completed (Step S7; YES), the drawing controller 815 allows the modification drawing tool 41*b* to perform a modification operation to modify the basic design on the surface of the nail T before the ink is dried or cured (Step S8).

Specifically, the drawing controller 815 drives the solenoid 440 for the drawing tool carriage 43 holding the modification drawing tool 41*b* and carries the modification drawing tool 41*b* down to a level for the modification operation, at which level the tip can touch the ink on the surface of the nail T.

The drawing controller 815 allows the tip of the modification drawing tool 41*b* to be cleaned by the cleaning mechanism 65 and then makes the tip of the modification drawing tool 41*b* touch the undried or uncured ink on the surface of the nail for the modification operation based on the modification data.

The modification drawing tool 41*b* may be moved to the cleaning mechanism 65 for the cleaning of the tip of the modification drawing tool 41*b* in the middle of the modification operation, e.g., every time a series of continuous motion is finished.

The drawing controller 815 then determines whether the modification operation has been completed (Step S9).

If determining that the modification operation has not been completed (Step S9; NO), the drawing controller 815 returns to Step S8 and repeats the process until the modification operation is completed.

If determining that the modification operation has been completed (Step S9; YES), the drawing controller 815 moves the drawing head 42 to the home space.

During the movement of the drawing head 42, the drawing controller 815 makes the drawing head 42 pass over the cleaning mechanism 65 so that the tip of the modification drawing tool 41*b* is cleaned by the blade 651 of the cleaning mechanism 65.

The drawing controller 815 further moves the drawing head 42 until the drawing tools 41*a* are above the drawing tool caps 62, fits the pen tips 412 of the drawing tools 41*a* into the drawing tool caps 62, and ends the drawing process for the nail T.

The case in which a nail design of a peacock pattern is drawn on a nail T will now be described with reference to FIGS. 8A to 8F.

First, a base color is applied to the entire surface of the nail T with a drawing tool 41*a* as shown in FIG. 8A.

Stripe line pattern is then drawn with ink on the base color with drawing tools 41*a* as shown in FIGS. 8B and 8C.

The drawing of a basic design is thus completed.

Next, a modification operation is performed in which the basic design drawn on the surface of the nail T is modified with the modification drawing tool 41*b* before the ink is completely dried or cured.

Specifically, for forming a peacock pattern, the modification drawing tool 41*b* is moved in the direction intersecting with the stripe line pattern of the basic design, as indicated by the arrows in FIG. 8D, in such a way that the tip of the modification drawing tool 41*b* runs softly on a part of the ink surface before the ink is completely dried or cured. Since the ink still has fluidity at this time, the ink in contact with the modification drawing tool 41*b* can be transferred.

FIG. 8E shows the modification operation by the modification drawing tool 41*b*.

Figure 8F:
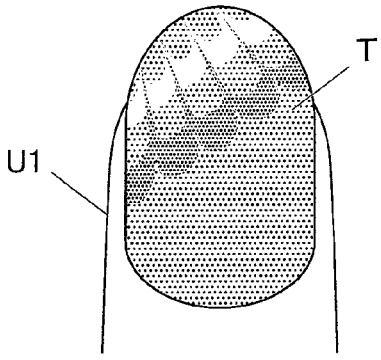
FIG. 8F shows an example of a completed peacock pattern.

FIG. 8F is an example completed nail design of a peacock pattern obtained through the modification operation.

In forming such a peacock pattern, the modification drawing tool 41*b* is preferably brought to the cleaning mechanism 65 for the tip cleaning each time a series of continuous motion (i.e., each motion indicated by each arrow in FIG. 8D) is finished.

The case in which a nail design of a marble pattern is drawn on a nail T will now be described with reference to FIGS. 9A to 9C.

First, irregular dot pattern is drawn on the entire surface of a nail T with drawing tools 41*a* as shown in FIG. 9A. The drawing of a basic design is thus completed.

Next, a modification operation is performed in which the basic design drawn on the surface of the nail T is modified with the modification drawing tool 41*b* before the ink is completely dried or cured.

Figure 9B:
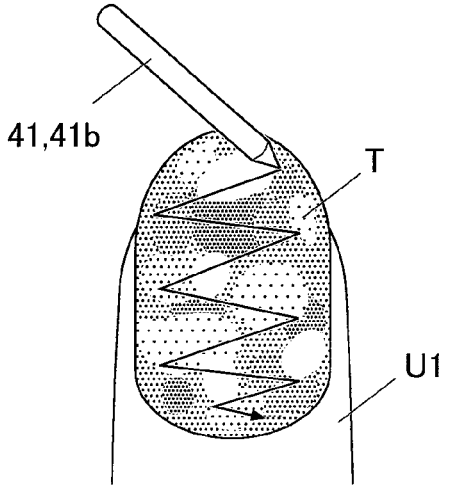
FIG. 9B shows a state in which modification is being made to the state of FIG. 9A in the direction indicated by the arrow.

Specifically, for forming a marble pattern, the modification drawing tool 41*b* is moved in a zigzag manner all over the dot pattern, as indicated by the arrow in FIG. 9B, in such a way that the tip of the modification drawing tool 41*b* runs softly almost all over the ink surface to stir the dot pattern of the basic design before the ink is completely dried or cured. Since the ink still has fluidity at this time, the ink can be greatly transferred over the entire surface of the nail T.

FIG. 9B shows the modification operation by the modification drawing tool 41*b*.

Figure 9C:
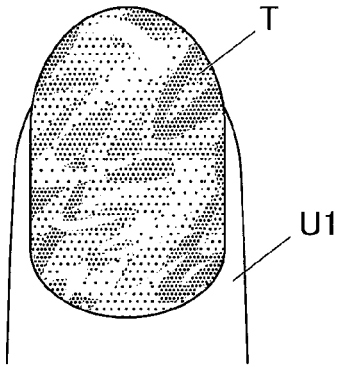
FIG. 9C shows an example of a completed marble pattern.

FIG. 9C is an example completed nail design of a marble pattern obtained through the modification operation.

In the case of such a marble pattern, performing the modification operation without a pause for tip cleaning does not affect the finish of the nail design, and there is no need for cleaning the tip of the modification drawing tool 41*b* in the middle of the modification operation.

The nail designs and the processes for forming them shown above (i.e., the types of basic designs and the ways to modify the basic designs) are illustrative only. The nail designs to be formed by the drawing apparatus 1 of the embodiment are not limited to those illustrated above.

For performing the drawing on the nails T of a plurality of fingers, a finger with the nail T for which drawing has completed is pulled out of the finger receiving section 31 and a finger with a next drawing target nail T is inserted in the finger receiving section 31 as a printing finger U1. The nail images of the nail T are then obtained. These processes are then repeated.

When a drawing tool (s) 41 is to be replaced, the drawing controller 815 moves the drawing head 42 to the position corresponding to the cover 23 for drawing tool replacement. A user can open the cover 23 for drawing tool replacement at this time to take out and replace a drawing tool (s) 41.

As described above, the drawing apparatus 1 of this embodiment allows the tip of the modification drawing tool 41*b* to touch the ink on the surface of a nail T for the modification operation on the basis of the modification data prepared for each design. The modification data includes information on the direction and distance of the movement. The modification operation allows a part of the ink to transfer.

The drawing apparatus 1 thus can easily create complicated nail designs, such as peacock pattern and marble pattern, like the ones created in nail salons.

If nail prints are made by hand work, it is very difficult to apply the same nail print of a peacock or marble pattern, obtained through the same modification, to the nails T of the fingers of both hands, or to share the same peacock or marble pattern nail print among a plurality of people.

By contrast, the drawing apparatus 1 of this embodiment stores modification data for each design and modifies basic designs on the basis of the modification data. This means that the modification operation is excellent in reproducibility and accuracy, and pattern obtained through the same modification can be created easily.

In this embodiment, the apparatus includes the drawing tools 41*a* as drawing members to apply ink to the surface of nails T, in addition to the modification drawing tool 41*b*.

This configuration allows the drawing apparatus 1 to automatically create basic designs. Nail designs, such as peacock and marble pattern, can thus be applied to nails T easily without requiring time and effort of a user.

In this embodiment, the apparatus includes the cleaning mechanism 65 to clean the tip of the modification drawing tool 41*b*.

The cleaning mechanism 65 can remove ink from the tip of the modification drawing tool 41*b* and thus can prevent mixture of ink colors on nails T, achieving beautiful finish of nail designs.

In this embodiment, the modification drawing tool 41*b* has the same external shape as each drawing tool 41*a* except that their tips are different from each other in external shape (i.e., a first tip for the modification drawing tool 41*b* and a second tip for the drawing tools 41*a*).

Accordingly, the mechanism to hold the modification drawing tool 41*b* on the drawing tool carriage 43 and the mechanism to move up and down the modification drawing tool 41*b* can be the same as those for each drawing tool 41*a*. This achieves a drawing apparatus having a simple structure to perform the modification operation.

It should be understood that the present invention is not limited to the above-described embodiment but may be modified in various manners without departing from the spirit of the invention.

For example, in the embodiment described above, the modification data is prepared in association with the image data of the basic design for each nail design. Association of the modification data with the image data of basic design, however, is not essential. The modification data may be stored independently instead.

For example, a basic design may be drawn on a nail T by means other than the drawing apparatus 1, and the drawing apparatus 1 may perform only the modification operation.

In this case, the drawing apparatus 1 only selects modification data as the selection of nail design (i.e., makes a selection as to how to move the modification drawing tool 41*b*) and only performs the modification operation by the modification drawing tool 41*b*.

More specifically, a user manually applies a base color and draws line pattern or dot pattern without using the drawing apparatus 1, and then inserts the nail T into the drawing apparatus 1 before the ink is dried. The drawing apparatus 1 then performs the modification operation using the modification drawing tool 41*b* in accordance with the modification data.

In this case, the drawing apparatus 1 does not necessarily have to include the drawing tools 41*a*.

In fact, basic designs for peacock pattern or marble pattern before being modified can be created merely by drawing lines or dot pattern at random and do not require such a difficult technique. The modification of the basic designs, however, requires fine work to obtain beautiful finish of the peacock or marble pattern.

For this reason, drawing a basic design on user's own nails T or others' nails T by hand work is relatively easy, whereas modifying the basic design uniformly to create the same peacock or marble pattern on all the nails T is difficult, especially with a non-dominant hand.

The drawing apparatus 1, which is advantageous because of the excellent reproducibility and accuracy in the modification operation, can uniformly and beautifully create the same peacock or marble pattern on the nails T of all the fingers.

In the embodiment described above, the modification drawing tool 41*b* runs on the surface of ink of the basic design to transfer the surface ink and modify the basic design. The ink to be transferred with the modification drawing tool 41*b*, however, is not limited to the ink on the top surface.

If a selected basic design includes a plurality of layers of ink coating a nail T (for example, two ink layers, i.e., a base color layer and line layer, are placed at the line parts in FIG.

8C), selection can be made as to whether only the topmost ink layer is to be transferred or whether both the topmost ink layer and the lower ink layer are to be transferred. Varying the ink layer to be transferred leads to variation in color and pattern appearing on the surface after the modification operation, allowing a user to enjoy a wide variety of nail designs.

A drawing tool up-and-down mechanism used in such a case should be able to make accurate control as to which level the modification drawing tool 41*b* is carried down to. Specifically, the apparatus obtains the information on height direction (or Z-axis direction), such as the height of the original nail and the increase in height produced by the applied ink layer.

In the embodiment described above, a plurality of (e.g., four) drawing tools 41 are attached to the drawing head 42 at one time. The number of drawing tools which can be attached to the drawing head 42 at one time may be only one, in which case a user may manually replace the drawing tool as appropriate. This can achieve a drawing apparatus 1 provided with a drawing tool inexpensively.

A mechanism to automatically replace a drawing tool attached to a drawing head may be applied.

Figure 10:
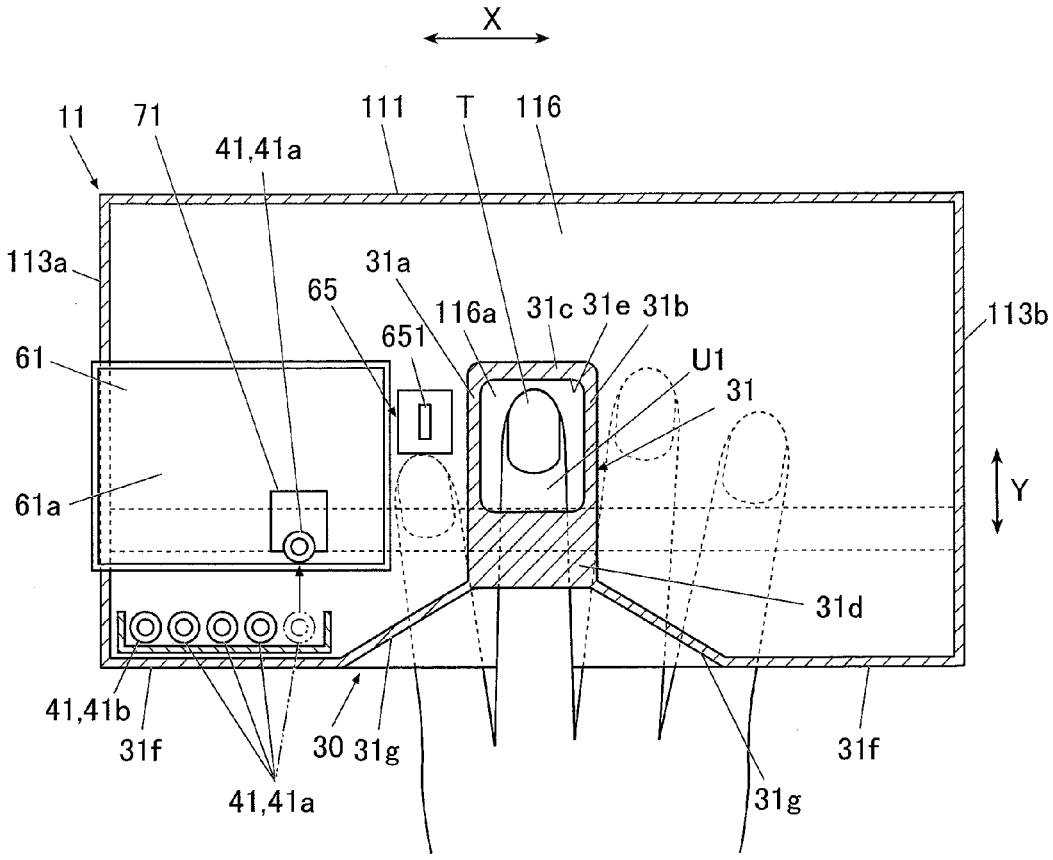
FIG. 10 is a top view of a dividing wall of a modification of the drawing apparatus.

In this case, a standby space is provided over the dividing wall 116 as shown in FIG. 10, and a plurality of drawing tools 41 (drawing tools 41*a* and modification drawing tool (s) 41*b*) are stored in the standby space. A drawing tool 41 is automatically selected from the standby space and attached to the drawing head 42. Such a configuration allows an increased number of drawing tools 41 for drawing and modification to be stored in the apparatus.

The structure of the drawing unit 40 is not limited to the one described in the above embodiment.

For example, the drawing apparatus 1 may be provided with a drawing unit 40 which includes a rotatable drawing tool carriage to hold a plurality of (e.g., eight) drawing tools, a carriage rotating mechanism to rotate the drawing tool carriage, and a drawing tool up-and-down mechanism to move the drawing tools held by the drawing tool carriage up and down.

A drawing apparatus with such a drawing unit 40 can hold more types of drawing tools (eight types at the maximum in this example) at one time for drawing and modification than in the embodiment described above. Such a drawing unit 40 can draw basic designs which require multiple colors, such as a rainbow pattern requiring seven colors and a gradation pattern requiring a plurality of inks having gradually different densities. The obtained basic designs with multiple colors are further modified with a modification tool, and thus complex and delicate nail designs can be easily created.

In the embodiment described above, the apparatus includes only one modification drawing tool 41*b*, but more than one modification drawing tools 41*b* may be provided to perform modification operation simultaneously. Such a configuration enables rapid modification operation, leading to reduction in time required for completing the nail art.

In the embodiment described above, the modification drawing tool 41*b* is moved linearly, but the modification drawing tool 41*b* may make any type of motion including circular motion and combination of some types of motions.

In the embodiment described above, solenoids are used as a drawing tool up-and-down mechanism to move the drawing tools 41 up and down. The configuration of the drawing tool up-and-down mechanism, however, is not limited to this. A step motor, a DC motor, or a motor and ball screw may be used instead.

In the embodiment described above, the X-direction movement stage 45 and the Y-direction movement stage 47 to move the drawing head 42 is constituted of the combination of the X-direction movement motor 46 and the Y-direction movement motor 48, which are step motors, and the ball screw and guide (not shown). The structure to move the drawing head 42, however, is not limited to this.

The X-direction movement motor 46 and the Y-direction movement motor 48 may have any configuration as long as they can freely move the drawing head 42 right and left and backwards and forwards. For example, a configuration using a mechanism constituted of shafts, guides, and wires, which are used for typical inexpensive printers; or a configuration using servomotors may be used.

In the embodiment described above, a slip of paper is used as a drawing medium for the drawing tools' warm-up drawing, but the drawing medium is not limited to a slip of paper. Roll paper may alternatively be used as a drawing medium. In such a case, a medium sending mechanism is provided to manually or automatically feed and reel the drawing medium. In the case of such a roll drawing medium, a medium opening is provided through which the roll drawing medium is to be inserted and removed, instead of the medium insertion/output opening 24.

In the embodiment described above, the drawing data generator 813 performs curved surface correction on the image data of a nail design to generate drawing data. Generation of drawing data by the drawing data generator 813, however, is not essential for the present invention. Alternatively, the image data of a nail design may be converted as appropriate using a lookup table (LUT) in the drawing controller 815 without separate generation of drawing data. In this case, the converted data is output to the drawing head and drawing control is performed for a drawing suitable for the nail shape, for example.

In the embodiment described above, the shape of a nail T is detected as nail information, and drawing data is generated on the basis of the detected shape. Detection of the nail shape, however, is not essential for the present invention. In a case in which extraction of the contour of a nail T is not essential, such as a case of drawing a small design mark in the middle of a nail T, accurate recognition of a nail shape is not necessary, and drawing can be performed without the detection of a nail shape.

Further, images taken by the cameras 51 are not limited to still images but may be moving images. In this case, a camera 51 shoots a moving image, and the top view of the nail T is captured as appropriate from the taken moving image to be used for the detection of nail information.

In the embodiment described above, the nail image storage area 821, the nail information storage area 822, and the nail design storage area 823 are provided in the storage unit 82 of the control device 80. These storage areas 821, 822, and 823, however, do not necessarily have to be provided in the storage unit 82 of the control device 80, but another storage unit may be provided for these storage areas 821, 822, and 823.

In the embodiment described above, fingers are inserted in the drawing apparatus 1 one by one so that drawing is performed on the fingers one by one. The present invention, however, may also be applied to a drawing apparatus that can perform drawing on multiple fingers in succession.

In this case, for example, the range within which the drawing tools are movable is increased for drawing for a larger range, so that the drawing is performed for multiple printing fingers U1 at a time.

Although various exemplary embodiments of the present invention have been shown and described, the invention is not limited to the embodiments shown but covers the scope of the claims and its equivalents.

What is claimed is:

1. A drawing apparatus comprising:

a drawing head which holds at least one modification member having a first tip at one end thereof and operates in such a way as to allow the first tip of the modification member to touch ink which is undried or uncured and is applied to a drawing target;

a movement mechanism which moves the drawing head, the movement mechanism comprising motors; and a CPU to control the drawing head and the movement mechanism, wherein:

the CPU controls a modification operation in which the movement mechanism moves the modification member by way of the drawing head while the first tip touches the ink on the drawing target so that a part of a pattern formed with the ink on the drawing target is modified;

image data of a design to be drawn on the drawing target includes modification data for controlling the modification operation;

the modification data includes (i) coordinate information of a modification starting position, (ii) vector information indicating a moving distance and a moving direction from the modification starting position for the modification operation, and (iii) information to specify a specific modification member to be used for the modification operation from among a plurality of modification members held by the drawing head, each of the plurality of modification members having a differently shaped first tip; and the CPU controls the modification operation in such a way that the drawing head brings the first tip of the specific modification member specified by the modification data into contact with a position identified by the coordinate information of the modification data on the ink on the drawing target, and that the movement mechanism moves the specific modification member based on the vector information of the modification data.

2. The drawing apparatus according to claim 1, wherein the drawing target is a nail of a finger or toe.

3. The drawing apparatus according to claim 1, wherein:

the drawing head holds a drawing member which has a second tip at one end thereof and which applies the ink to the drawing target when the second tip touches the drawing target, and the drawing head operates in such a way as to allow the second tip of the drawing member to touch the drawing target; and the CPU controls a drawing operation in which the movement mechanism moves the drawing member by way of the drawing head while the second tip is touching the drawing target so that the pattern is formed on the drawing target.

4. The drawing apparatus according to claim 3, wherein a part of the modification member except the first tip and a part of the drawing member except the second tip have a same external shape.

5. The drawing apparatus according to claim 1, further comprising a cleaning mechanism to perform a cleaning operation in which the cleaning mechanism cleans the first tip when the first tip comes into contact with the cleaning mechanism.

6. The drawing apparatus according to claim 5, wherein:

the cleaning mechanism comprises a contact member fixed at a position which allows the first tip to come into contact with the contact member, the contact member being made of material having flexibility; and the CPU controls the movement mechanism to move the modification member in such a way that the first tip passes a contact position at least once at a time of the cleaning operation, the contact position being a position at which the first tip comes into contact with the contact member.

7. The drawing apparatus according to claim 1, wherein:

the pattern has a stripe line pattern; and the CPU controls the modification member to move in a direction intersecting with the stripe line pattern in the modification operation to form a peacock pattern on the drawing target, the peacock pattern being obtained through the modification of the stripe line pattern.

8. The drawing apparatus according to claim 1, wherein:

the pattern has a dot pattern; and the CPU controls the modification member to move in a zigzag manner all over the dot pattern in the modification operation to form a marble pattern on the drawing target, the marble pattern being obtained through the modification of the dot pattern.

9. A drawing method for a drawing apparatus, the method comprising:

allowing a drawing head to hold at least one modification member having a first tip at one end thereof;

allowing, with the drawing head, the first tip of the modification member to touch ink which is undried or uncured and is applied to a drawing target; and performing a modification operation in which the modification member is moved by way of the drawing head while the first tip touches the ink so that a part of a pattern formed with the ink on the drawing target is modified, wherein:

image data of a design to be drawn on the drawing target includes modification data for controlling the modification operation;

the modification data includes (i) coordinate information of a modification starting position, (ii) vector information indicating a moving distance and a moving direction from the modification starting position for the modification operation, and (iii) information to specify a specific modification member to be used for the modification operation from among a plurality of modification members held by the drawing head, each of the plurality of modification members having a differently shaped first tip; and the modification operation is performed in such a way that the first tip of the specific modification member specified by the modification data is brought into contact with a position identified by the coordinate information of the modification data on the ink on the drawing target, and that the specific modification member is moved based on the vector information of the modification data.

10. The drawing method according to claim 9, the method further comprising:

allowing the drawing head to hold a drawing member having a second tip at one end thereof, the drawing member applying the ink to the drawing target when the second tip touches the drawing target;

allowing, with the drawing head, the second tip of the drawing member to touch the drawing target; and performing a drawing operation in which the drawing member is moved through the drawing head while the second tip is touching the drawing target so that the pattern is formed on the drawing target.

11. The drawing method according to claim 9, wherein:

the drawing apparatus includes a cleaning mechanism including a contact member to come into contact with the first tip; and the modification member is moved in such a way that the first tip passes a contact position at least once for the first tip to be cleaned by the contact member of the cleaning mechanism, the contact position being a position at which the first tip comes into contact with the contact member.

12. The drawing method according to claim 9, wherein:

the pattern has a stripe line pattern; and the modification member is moved in a direction intersecting with the stripe line pattern in the modification operation so that a peacock pattern is formed on the drawing target, the peacock pattern being obtained through the modification of the stripe line pattern.

13. The drawing method according to claim 9, wherein:

the pattern has a dot pattern; and the modification member is moved in a zigzag manner all over the dot pattern in the modification operation so that a marble pattern is formed on the drawing target, the marble pattern being obtained through the modification of the dot pattern.

14. A drawing apparatus comprising:

a drawing head which holds at least one modification member having a first tip at one end thereof and operates in such a way as to allow the first tip of the modification member to touch ink which is undried or uncured and is applied to a drawing target;

a movement mechanism which moves the drawing head, the movement mechanism comprising motors; and a CPU to control the drawing head and the movement mechanism, wherein:

the CPU controls a modification operation in which the movement mechanism moves the modification member by way of the drawing head while the first tip touches the ink on the drawing target so that a part of a pattern formed with the ink on the drawing target is modified; and in a case in which the pattern has a stripe line pattern, the CPU controls the modification member to move in a direction intersecting with the stripe line pattern in the modification operation to form a peacock pattern on the drawing target, the peacock pattern being obtained through the modification of the stripe line pattern.

15. A drawing method for a drawing apparatus, the method comprising:

allowing a drawing head to hold at least one modification member having a first tip at one end thereof;

allowing, with the drawing head, the first tip of the modification member to touch ink which is undried or uncured and is applied to a drawing target; and performing a modification operation in which the modification member is moved by way of the drawing head while the first tip touches the ink so that a part of a pattern formed with the ink on the drawing target is modified, wherein in a case in which the pattern has stripe line pattern, the modification member is moved in a direction intersecting with the stripe line pattern in the modification operation so that a peacock pattern is formed on the drawing target, the peacock pattern being obtained through the modification of the stripe line pattern.

* * * * *